US007370707B2

(12) United States Patent
McDaniel et al.

(10) Patent No.: US 7,370,707 B2
(45) Date of Patent: May 13, 2008

(54) METHOD AND APPARATUS FOR HANDLING WELLBORE TUBULARS

(75) Inventors: Gary McDaniel, Lafayette, LA (US); Allen Keith Thomas, Jr., Houston, TX (US); Patrick D. Cummins, Lafayette, LA (US); Troy F. Hill, Lafayette, LA (US); Tracy J. Cummins, The Woodlands, TX (US); Doyle Frederic Boutwell, Jr., Houston, TX (US); Michael Hayes, Lafayette, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 400 days.

(21) Appl. No.: 10/818,183

(22) Filed: Apr. 5, 2004

(65) Prior Publication Data

US 2005/0000696 A1 Jan. 6, 2005

Related U.S. Application Data

(60) Provisional application No. 60/460,193, filed on Apr. 4, 2003.

(51) Int. Cl.
*E21B 19/06* (2006.01)

(52) U.S. Cl. ..... 166/380; 166/77.1; 166/77.51; 166/78.1; 166/85.5; 166/77.52

(58) Field of Classification Search ..... 166/78.1, 166/77.1, 77.51–77.53, 380, 85.1, 85.5, 75.11; 175/423; 173/164; 277/606
See application file for complete search history.

(56) References Cited

U.S. PATENT DOCUMENTS 122,514 A 1/1872 Bullock
179,973 A * 7/1876 Thornton ..... 166/77.52
1,077,772 A 11/1913 Weathersby
1,185,582 A 5/1916 Bignell
1,301,285 A 4/1919 Leonard
1,342,424 A 6/1920 Cotten
1,418,766 A 6/1922 Wilson (Continued)

FOREIGN PATENT DOCUMENTS

CA 2 307 386 11/2000

(Continued)

OTHER PUBLICATIONS

PCT Search Report, International Application No. PCT/US2004/010442, dated Sep. 20, 2004.

(Continued)

*Primary Examiner*—Richard E. Chilcot, Jr.
*Assistant Examiner*—Matthew J Smith
(74) *Attorney, Agent, or Firm*—Patterson & Sheridan, LLP

(57) ABSTRACT

Aspects of the present invention provide a tubular handling system for handling wellbore tubulars. In one aspect, the present invention provides a tubular handling system adapted to retain a tubular without damaging the outer surface of the tubular. In another aspect, the present invention provides a method of connecting tubulars by remotely controlling the connection process, including joint compensation, alignment, make up, and interlock. In one embodiment, the tubular handling system comprises an elevator adapted to support a tubular utilizing a first portion of an upset of the tubular and a spider adapted to support the tubular utilizing a second portion of the upset. In another embodiment, at least one of the elevator and the spider is remotely controllable. In yet another embodiment, the tubular handling system comprising a joint compensator system adapted to provide fluid communication to the elevator during rotation of the tubular.

53 Claims, 22 Drawing Sheets

U.S. PATENT DOCUMENTS

| | | | | |
|---|---|---|---|---|
| 1,471,526 | A | | 10/1923 | Pickin |
| 1,541,669 | A | | 6/1925 | Summers |
| 1,585,069 | A | | 5/1926 | Youle |
| 1,726,136 | A | | 9/1929 | Power |
| 1,777,592 | A | | 10/1930 | Thomas |
| 1,805,007 | A | | 5/1931 | Pedley |
| 1,825,026 | A | | 9/1931 | Thomas |
| 1,830,625 | A | | 11/1931 | Schrock |
| 1,842,638 | A | | 1/1932 | Wigle |
| 1,880,218 | A | | 10/1932 | Simmons |
| 1,917,135 | A | | 7/1933 | Littell |
| 1,981,525 | A | | 11/1934 | Price |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,063,361 | A | | 12/1936 | Baash |
| 2,105,885 | A | | 1/1938 | Hinderliter |
| 2,128,430 | A | | 8/1938 | Pryor |
| 2,167,338 | A | | 7/1939 | Murcell |
| 2,184,681 | A | | 12/1939 | Osmun et al. |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,298,507 | A | | 10/1942 | Penick et al. |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,536,458 | A | | 1/1951 | Munsinger |
| 2,570,080 | A | * | 10/1951 | Stone ..... 173/164 |
| 2,589,159 | A | | 3/1952 | Stone |
| 2,610,690 | A | | 9/1952 | Beatty |
| 2,621,742 | A | | 12/1952 | Brown |
| 2,627,891 | A | | 2/1953 | Clark |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,934,148 | A | | 4/1960 | Allaire |
| 2,953,406 | A | | 9/1960 | Young |
| 2,965,177 | A | | 12/1960 | Bus, Sr. et al. |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,063,509 | A | | 11/1962 | Guier |
| 3,087,546 | A | | 4/1963 | Wooley |
| 3,090,031 | A | | 5/1963 | Lord |
| 3,099,323 | A | | 7/1963 | Kelley |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,188,708 | A | | 6/1965 | O'Haver |
| 3,191,677 | A | | 6/1965 | Kinley |
| 3,191,680 | A | | 6/1965 | Vincent |
| 3,193,116 | A | | 7/1965 | Kenneday et al. |
| 3,266,582 | A | | 8/1966 | Homanick |
| 3,287,776 | A | | 11/1966 | Brown |
| 3,330,354 | A | | 7/1967 | Chamblee |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberty, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. |
| 3,638,989 | A | | 2/1972 | Sandquist |
| 3,656,564 | A | | 4/1972 | Brown |
| 3,662,842 | A | | 5/1972 | Bromell |
| 3,669,190 | A | | 6/1972 | Sizer et al. |
| 3,675,278 | A | | 7/1972 | Powell |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,706,347 | A | | 12/1972 | Brown |
| 3,729,057 | A | | 4/1973 | Werner |
| 3,746,330 | A | | 7/1973 | Taciuk |
| 3,747,675 | A | | 7/1973 | Brown |
| 3,748,702 | A | | 7/1973 | Brown |
| 3,760,894 | A | | 9/1973 | Pitifer |
| 3,766,991 | A | | 10/1973 | Brown |
| 3,776,320 | A | | 12/1973 | Brown |
| 3,780,883 | A | | 12/1973 | Brown |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,884 | A | | 11/1974 | West |
| 3,857,450 | A | | 12/1974 | Guier |
| 3,870,114 | A | | 3/1975 | Pulk et al. |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosl et al. |
| 3,915,244 | A | | 10/1975 | Brown |
| 3,934,660 | A | | 1/1976 | Nelson |
| 3,945,444 | A | | 3/1976 | Knudson |
| 3,947,009 | A | | 3/1976 | Nelmark |
| 3,964,552 | A | * | 6/1976 | Slator ..... 173/164 |
| 3,964,556 | A | | 6/1976 | Gearhart et al. |
| 3,980,143 | A | | 9/1976 | Swartz et al. |

4,029,425 A * 6/1977 Pelsue ..... 277/606
4,049,066 A 9/1977 Richey
4,054,332 A 10/1977 Bryan, Jr.
4,054,426 A 10/1977 White
4,064,939 A 12/1977 Marquis
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,202,225 A * 5/1980 Sheldon et al. ..... 173/164
4,209,066 A 6/1980 Watson
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,326,745 A 4/1982 Guier
4,336,415 A 6/1982 Walling
4,354,706 A 10/1982 Coyle, Sr.
4,381,584 A 5/1983 Coyle, Sr.
4,384,627 A 5/1983 Ramirez-Jauregui
4,392,534 A 7/1983 Miida
4,396,076 A 8/1983 Inoue
4,396,077 A 8/1983 Radtke
4,396,216 A 8/1983 Hamilton
4,407,378 A 10/1983 Thomas
4,408,669 A 10/1983 Wiredal
4,413,682 A 11/1983 Callihan et al.
4,421,447 A 12/1983 Gudgel et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,523,645 A 6/1985 Moore
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,600,054 A 7/1986 Miller et al.
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,643,259 A 2/1987 Zeringue, Jr.
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,715,456 A 12/1987 Poe, Jr. et al.
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.

4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller et al.
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,335,756 A 8/1994 Penisson
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,484,040 A 1/1996 Penisson
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,609,226 A 3/1997 Penisson
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.

5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,848,647 A 12/1998 Webre et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,089,338 A 7/2000 Bouligny, Jr.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,192,981 B1 2/2001 Boquet et al.
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,399 B1 4/2002 Bangert
6,378,627 B1 4/2002 Tubel et al.
6,378,630 B1 4/2002 Ritorto et al.
6,378,633 B1 4/2002 Moore et al.
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd

| | | | | |
|---|---|---|---|---|
| 6,554,064 | B1 | 4/2003 | Restarick et al. | |
| 6,585,040 | B2 | 7/2003 | Hanton et al. | |
| 6,591,471 | B1 | 7/2003 | Hollingsworth et al. | |
| 6,595,288 | B2 | 7/2003 | Mosing et al. | |
| 6,619,402 | B1 | 9/2003 | Amory et al. | |
| 6,622,796 | B1 | 9/2003 | Pietras | |
| 6,634,430 | B2 | 10/2003 | Dawson et al. | |
| 6,637,526 | B2 | 10/2003 | Juhasz et al. | |
| 6,648,075 | B2 | 11/2003 | Badrak et al. | |
| 6,651,737 | B2 | 11/2003 | Bouligny et al. | |
| 6,655,460 | B2 | 12/2003 | Bailey et al. | |
| 6,666,274 | B2 | 12/2003 | Hughes | |
| 6,668,684 | B2 | 12/2003 | Allen et al. | |
| 6,668,937 | B1 | 12/2003 | Murray | |
| 6,679,333 | B2 * | 1/2004 | York et al. | 166/380 |
| 6,688,394 | B1 | 2/2004 | Ayling | |
| 6,688,398 | B2 | 2/2004 | Pietras | |
| 6,691,801 | B2 | 2/2004 | Juhasz et al. | |
| 6,698,595 | B2 | 3/2004 | Norell et al. | |
| 6,702,040 | B1 | 3/2004 | Sensenig | |
| 6,708,769 | B2 | 3/2004 | Haugen et al. | |
| 6,715,430 | B2 | 4/2004 | Choi et al. | |
| 6,719,071 | B1 | 4/2004 | Moyes | |
| 6,725,924 | B2 | 4/2004 | Davidson et al. | |
| 6,725,938 | B1 | 4/2004 | Pietras | |
| 6,732,822 | B2 | 5/2004 | Slack et al. | |
| 6,742,584 | B1 | 6/2004 | Appleton | |
| 6,742,596 | B2 * | 6/2004 | Haugen | 166/380 |
| 6,742,606 | B2 | 6/2004 | Metcalfe et al. | |
| 6,745,834 | B2 | 6/2004 | Davis et al. | |
| 6,752,211 | B2 | 6/2004 | Dewey et al. | |
| 6,776,233 | B2 | 8/2004 | Meehan | |
| 6,832,656 | B2 | 12/2004 | Fournier, Jr. et al. | |
| 6,832,658 | B2 | 12/2004 | Keast | |
| 6,837,313 | B2 | 1/2005 | Hosie et al. | |
| 6,840,322 | B2 | 1/2005 | Haynes | |
| 6,848,517 | B2 | 2/2005 | Wardley | |
| 6,854,533 | B2 | 2/2005 | Galloway et al. | |
| 6,857,486 | B2 | 2/2005 | Chitwood et al. | |
| 6,857,487 | B2 | 2/2005 | Galloway et al. | |
| 6,868,906 | B1 | 3/2005 | Vail, III et al. | |
| 6,877,553 | B2 | 4/2005 | Cameron | |
| 6,889,772 | B2 | 5/2005 | Buytaert et al. | |
| 6,892,835 | B2 | 5/2005 | Shahin et al. | |
| 6,896,075 | B2 | 5/2005 | Haugen et al. | |
| 6,899,186 | B2 | 5/2005 | Galloway et al. | |
| 6,907,934 | B2 | 6/2005 | Kauffman et al. | |
| 7,096,977 | B2 | 8/2006 | Juhasz et al. | |
| 7,100,698 | B2 | 9/2006 | Kracik et al. | |
| 2001/0042625 | A1 | 11/2001 | Appleton | |
| 2002/0029878 | A1 * | 3/2002 | Victor | 166/75.11 |
| 2002/0040787 | A1 | 4/2002 | Cook et al. | |
| 2002/0066556 | A1 | 6/2002 | Goode et al. | |
| 2002/0096337 | A1 | 7/2002 | Bouligny et al. | |
| 2002/0108748 | A1 | 8/2002 | Keyes | |
| 2002/0170720 | A1 | 11/2002 | Haugen | |
| 2002/0189863 | A1 | 12/2002 | Wardley | |
| 2003/0029641 | A1 | 2/2003 | Meehan | |
| 2003/0056991 | A1 | 3/2003 | Hahn et al. | |
| 2003/0066718 | A1 | 4/2003 | Buck | |
| 2003/0070841 | A1 | 4/2003 | Merecka et al. | |
| 2003/0111267 | A1 | 6/2003 | Pia | |
| 2003/0141111 | A1 | 7/2003 | Pia | |
| 2003/0146023 | A1 | 8/2003 | Pia | |
| 2003/0155159 | A1 | 8/2003 | Stack et al. | |
| 2003/0164251 | A1 | 9/2003 | Tulloch | |
| 2003/0164276 | A1 | 9/2003 | Snider et al. | |
| 2003/0173073 | A1 | 9/2003 | Snider et al. | |
| 2003/0173090 | A1 | 9/2003 | Cook et al. | |
| 2003/0173117 | A1 | 9/2003 | Mason et al. | |
| 2003/0217865 | A1 | 11/2003 | Simpson et al. | |
| 2003/0221519 | A1 | 12/2003 | Haugen et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0060697 | A1 | 4/2004 | Tilton et al. | |
| 2004/0069500 | A1 | 4/2004 | Haugen | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0216892 | A1 | 11/2004 | Giroux et al. | |
| 2004/0216924 | A1 | 11/2004 | Pietres et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0051343 | A1 | 3/2005 | Pietras et al. | |
| 2005/0096846 | A1 | 5/2005 | Koithan et al. | |
| 2005/0098352 | A1 | 5/2005 | Beierbach et al. | |

FOREIGN PATENT DOCUMENTS

| | | |
|---|---|---|
| CA | 2 284 428 | 4/2001 |
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| DE | 19814033 | 10/1999 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0 479 583 | 4/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2658972 | 8/1991 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |

| | | |
|---|---|---|
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 2 014 215 | 8/1979 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 355 030 | 4/2001 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 388 626 | 9/2003 |
| GB | 2 389 130 | 12/2003 |
| JP | 2001-173349 | 6/2001 |
| WO | WO 90-06418 | 6/1990 |
| WO | WO 91-16520 | 10/1991 |
| WO | WO 92-01139 | 1/1992 |
| WO | WO 92-18743 | 10/1992 |
| WO | WO 92-20899 | 11/1992 |
| WO | WO 93-07358 | 4/1993 |
| WO | WO 93-24728 | 12/1993 |
| WO | WO 95-10686 | 4/1995 |
| WO | WO 96-18799 | 6/1996 |
| WO | WO 96-28635 | 9/1996 |
| WO | WO 97-05360 | 2/1997 |
| WO | WO 97-08418 | 3/1997 |
| WO | WO 98/01651 | 1/1998 |
| WO | WO 98-05844 | 2/1998 |
| WO | WO 98-09053 | 3/1998 |
| WO | WO 98-11322 | 3/1998 |
| WO | WO 98-32948 | 7/1998 |
| WO | WO 98-55730 | 12/1998 |
| WO | WO 99-04135 | 1/1999 |
| WO | WO 99-11902 | 3/1999 |
| WO | WO 99-23354 | 5/1999 |
| WO | WO 99-24689 | 5/1999 |
| WO | WO 99-35368 | 7/1999 |
| WO | WO 99-37881 | 7/1999 |
| WO | WO 99-41485 | 8/1999 |
| WO | WO 99-50528 | 10/1999 |
| WO | WO 99-58810 | 11/1999 |
| WO | WO 99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00/41487 | 7/2000 |
| WO | WO 00-46484 | 8/2000 |
| WO | WO 00-50730 | 8/2000 |
| WO | WO 00/52297 | 9/2000 |
| WO | WO 00-66879 | 11/2000 |
| WO | WO 01-12946 | 2/2001 |
| WO | WO 01/33033 | 5/2001 |
| WO | WO 01-46550 | 6/2001 |
| WO | WO 01/59253 | 8/2001 |
| WO | WO 01/69034 | 9/2001 |
| WO | WO 01-79650 | 10/2001 |
| WO | WO 01/79652 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 02/092959 | 11/2002 |
| WO | WO 03/006790 | 1/2003 |
| WO | WO 03/038229 | 5/2003 |
| WO | WO 03-074836 | 9/2003 |
| WO | WO 03-087525 | 10/2003 |
| WO | WO 2004/022903 | 3/2004 |
| WO | WO 2004/079155 | 9/2004 |

OTHER PUBLICATIONS

Alexander Sas-Jaworsky and J. G. Williams, Development of Composite Coiled Tubing For Oilfield Services, SPE 26536, Society of Petroleum Engineers, Inc., 1993.

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.

G. F. Boykin, The Role of A Worldwide Drilling Organization and the Road to the Future, SPE/IADC 37630, 1997.

M. S. Fuller, M. Littler, and I. Pollock, Innovative Way To Cement a Liner Utilizing a New Inner String Liner Cementing Process, 1998.

Helio Santos, Consequences and Relevance of Drillstring Vibration on Wellbore Stability, SPE/IADC 52820, 1999.

Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.

C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.

Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.

Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.

Coiled Tubing Handbook, World Oil, Gulf Publishing Company, 1993.

U.S. Appl. No. 10/189,570, filed Jun. 6, 2002.

U.S. Appl. No. 10/618,093, filed Jul. 11, 2003.

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Developments Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-7.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.

Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, Tesco Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, Tesco Drilling Technology, Apr. 1998, 2 Pages.
500 or 650 HCIS Top Drive, Powerful Hydraulic Compact Top Drive Drilling System, Tesco Drilling Technology, Apr. 1998, 2 Pages.
Product Information (Sections 1-10) Canrig Drilling Technology, Ltd., Sep. 18, 1996.
G.H. Kamphorst, G. L. Van Wechem, W. Boom, D. Bottger, and K. Koch, Casing Running Tool, SPE/IADC 52770.
Dennis L. Bickford and Mark J. Mabile, Casing Drilling Rig Selection For Stratton Field, Texas, World Oil, vol. 226 No., Mar. 2005.
GB Examination Report, Application No. 0519517.7, Feb. 5, 2007.

* cited by examiner

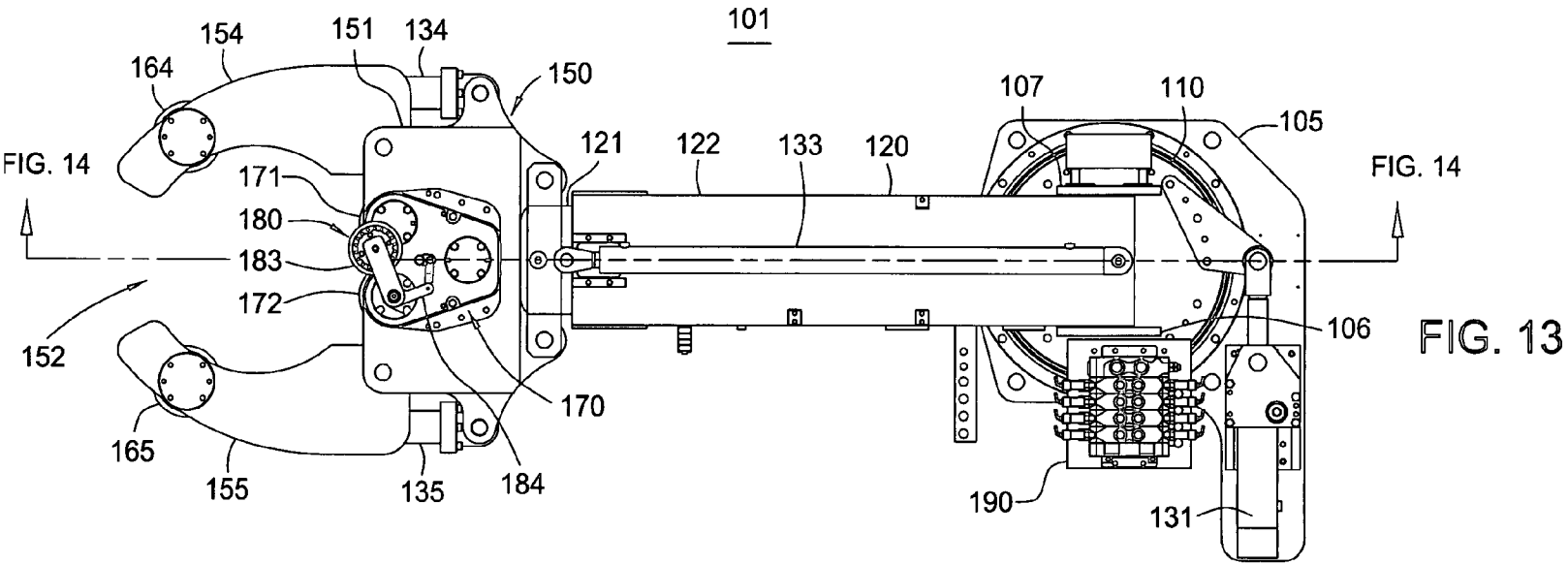
FIG. 13
101
105
106
107
110
120
121
122
131
133
134
135
150
151
152
154
155
164
165
170
171
172
180
183
184
190
FIG. 14
FIG. 14
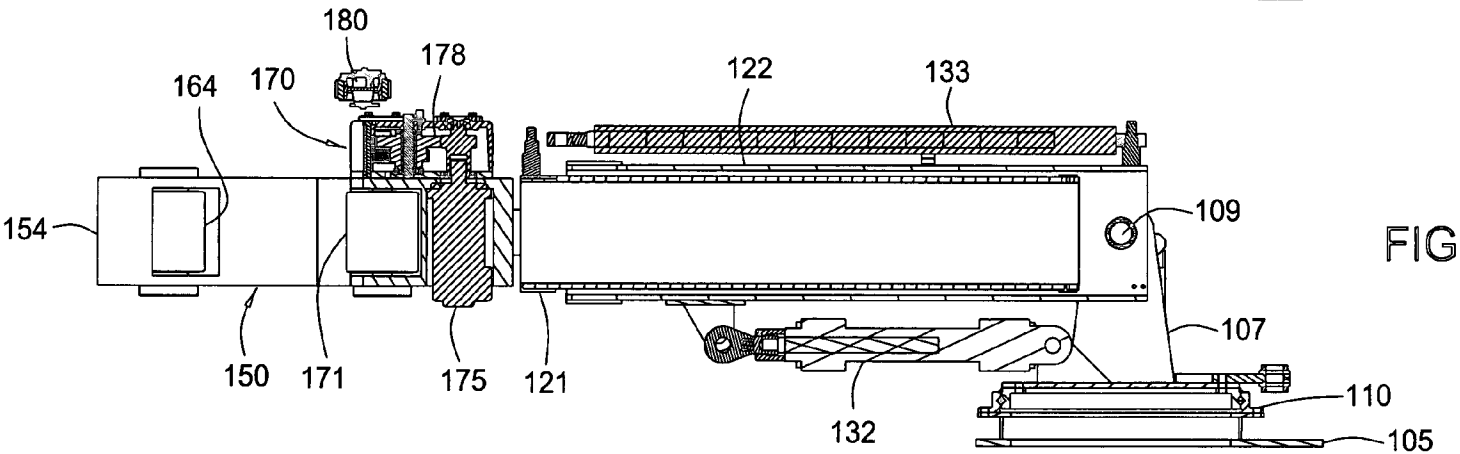
FIG. 14
105
107
109
110
121
122
132
133
150
154
164
170
171
175
178
180

METHOD AND APPARATUS FOR HANDLING WELLBORE TUBULARS

CROSS REFERENCE TO RELATED APPLICATIONS

This application claims benefit of U.S. Provisional Patent Application Ser. No. 60/460,193, filed Apr. 4, 2003, which application is herein incorporated by reference in its entirety.

BACKGROUND OF THE INVENTION

1. Field of the Invention

The present invention relates to methods and apparatus of handling tubulars in and around a wellbore. More particularly, the invention relates to methods and apparatus to facilitate the formation of tubular strings. More particularly still, the invention relates to apparatus and methods for remote controlling the tubular connection process. More particularly still, the invention relates to methods and apparatus for supporting a string of tubular riser for use between an offshore oil and gas platform and the ocean floor.

2. Description of the Related Art

Wells are drilled and produced using strings of tubular that are threaded together. For example, wellbore are formed by disposing a drill bit at the end of a drill string. Due to the torsional forces present when rotating a bit at the end of the string that may be thousands of feet long, the connection in drill string include a shoulder that can be torqued to a certain value. Other tubulars that line a borehole or serve as a fluid path for production fluids have a simpler threaded connection that only has to be fluid tight.

With the advent of offshore drilling, a riser is commonly used to isolate drill string or production tubing from the ocean water. Riser is relatively large diameter tubing that extends between an offshore rig floor and a wellhead at the ocean floor. Because the well is sometimes in hundreds of feet of water, riser can be hundreds of feet long and must bend and sway with the ocean current and in some cases, with the movement and drift of a platform at the surface. In addition to its relatively large diameter, riser typically has a large upset portion at one end where it is threadedly connected to another piece of riser to form a string.

Due to its function of providing isolation between possible hazardous material and the ocean, it is desirable not to damage, scratch, or mar the outer surface of riser with tongs or other gripping devices that are typically used to date on a rig floor to connect sequential pieces of tubular pipe. For example, tubular strings are made today at a well site with the use of an elevator that can grasp a piece of tubular, lift it above the well center, and lower it into a threaded portion of another tubular extending from the well. Once the tubulars are connected, the elevator then lowers the entire string to a position where it can be grasped by another gripping apparatus known as a spider.

At any time, either the spider or the elevator or both must be able to retain the string. The prior art elevators and spiders necessarily grasp the outer diameter of the tubulars in order to retain them axially. The spiders and elevators often use a die to enhance their ability to grip the tubulars. However, the die tends to damage, scratch, or mar the outer surface of the tubular body. While the collateral damage to the outside of the tubulars is of little concern with liner or casing, it is often unacceptable with riser.

There is a need therefore, for a method and apparatus for handing tubulars at a well that does not result in damage to the outer surface of the tubulars. There is also a need for remotely controlling the tubular handling or connection process. There is a further need for a method and apparatus that permits the formation of tubular strings without utilizing the outer surface of the tubulars for axial retention.

SUMMARY OF THE INVENTION

Aspects of the present invention provide a tubular handling system for handling wellbore tubulars. In one aspect, the present invention provides a tubular handling system adapted to retain a tubular without damaging the outer surface of the tubular. In another aspect, the present invention provides a method of connecting tubulars by remotely controlling the connection process, including joint compensation, alignment, make up, and interlock.

In one embodiment, the tubular handling system comprises a first support member adapted to support a tubular utilizing a first portion of an upset of the tubular and a second support member adapted to support the tubular utilizing a second portion of the upset. In another embodiment, at least one of the first support member and the second support member is remotely controllable. In yet another embodiment, the first and second support members are adapted to support the tubular at the same time. Preferably, the tubular comprises a riser.

In another aspect, the tubular handling system further comprises a joint compensator.

In another aspect still, the tubular handling system further comprises a rotary seal adapted to provide communication between the first support member and a controller. The rotary seal allows a fluid to be transmitted to the first support member during rotation of the tubular.

In another aspect still, the tubular handling system further comprises a rotary table for supporting the second support member. Preferably, the rotary table is adapted to absorb a force experienced by the second support member. In one embodiment, the rotary table comprises a polyurethane layer. In another embodiment, the rotary table comprises one or more piston and cylinder assemblies. In another aspect, the rotary table is remotely controllable between an open position and a closed position.

In another aspect still, the tubular handling system further comprises an interlock system for ensuring the tubular is retained by at least one of the first support member and the second support member.

In another aspect still, the tubular handling system further comprises a tubular guide member for positioning the tubular. In one embodiment, the tubular guide member comprises a conveying member and a gripping member, wherein the conveying member moves the gripping member into engagement with the tubular.

In another aspect still, the tubular handling system further comprises a tong assembly for connecting the tubular with a second tubular.

In another aspect still, the tubular handling system further comprises a tong positioning device. In one embodiment, the tong positioning device comprises a single extendable beam having variable length. In another embodiment, the tong positioning device comprises a movable frame. In yet another embodiment, the tong positioning device comprises a flexible chain provided with compression members and a flexible locking chain.

In another aspect, the present invention provides a method of handling a tubular comprising supporting the tubular along a first portion of an upset using a first support member and supporting the tubular along a second portion of the upset using a second support member. In one embodiment, the method further comprises remotely controlling at least one of the first support member and the second support member. In another aspect, the method includes providing a fluid to first support member during rotation of the tubular.

In another embodiment, the method is used to connect the tubular to a second tubular. To connect the tubulars, the method may further comprise compensating for movement of the tubular during the connection. In another aspect, the method further comprises providing a rotary seal to provide communication between the first support member and a controller. The method may also comprise aligning the tubular with the second tubular using a tubular guide member. The tubulars may be aligned by recalling a memorized position of a previously aligned tubular.

In another aspect, the tubulars are connected by rotating the tubular relative to the second tubular using a tong assembly. The tong for rotating the tubular may be translated into position to connect the tubulars. The method also includes remotely operating the tong assembly.

In another aspect, the method includes absorbing a load experienced by the second support member. In one embodiment, the load is absorbed by the rotary table. The method also includes disposing the second support member on a rotary table. In another embodiment, the method includes remotely opening or closing the rotary table.

In another aspect still, the method of handling the tubular includes ensuring at least one of the first support member or the second support member is retaining the tubular.

In another aspect, the present invention provides a joint compensation system for a wellbore tubular. The joint compensation system includes a joint compensator; an elevator for retaining the tubular, the elevator coupled to the joint compensator; and a rotary seal operatively coupled to the elevator to provide communication between the elevator and a controller. In one embodiment, communication between the elevator and the controller comprises sending a fluid signal or an electric signal. In another embodiment, the rotary seal maintains communication between the elevator and the controller during rotation of the elevator. In yet another embodiment, the elevator is a side door elevator. In yet another embodiment, the elevator comprises a fluid operated piston and cylinder assembly.

In another aspect, the present invention provides a load absorbing table for a tubular gripping member comprising a load absorbing member disposed on a flat support member. In one embodiment, the load absorbing member comprises a polyurethane layer. In another embodiment, the table is movable between an open position and a closed position. In yet another embodiment, the load absorbing member comprises one or more piston and cylinder assemblies. Preferably, the one or more piston and cylinder assemblies are fluid operated. In another embodiment, the table is flush mounted. In yet another embodiment, the table is remotely operable. In yet another embodiment, the table is adapted to compensate for rig movement, thereby maintaining the flat support member in a substantially horizontal position.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 13 is a top view of a tubular guide member shown in FIG. 1.

FIG. 14 is a cross-sectional view of the tubular guide member of FIG. 13 along line A-A.

DETAILED DESCRIPTION OF THE PREFERRED EMBODIMENT

Aspects of the present invention provide a tubular handling system 100 for making up or breaking out tubulars. In one aspect, the tubular handling system 100 is adapted retain a tubular without damaging the outer surface of the tubular body. In another aspect, at least part of the tubular handling process is remotely controllable.

For clarity purposes, the tubular handling system will be described with respect to the make up process. However, it is understood that the system may also be used to break out tubulars. Additionally, although the make up process is described for a riser, the process is equally applicable to other types of wellbore tubulars such as casing, drill pipe, and tubing.

Figure 1:
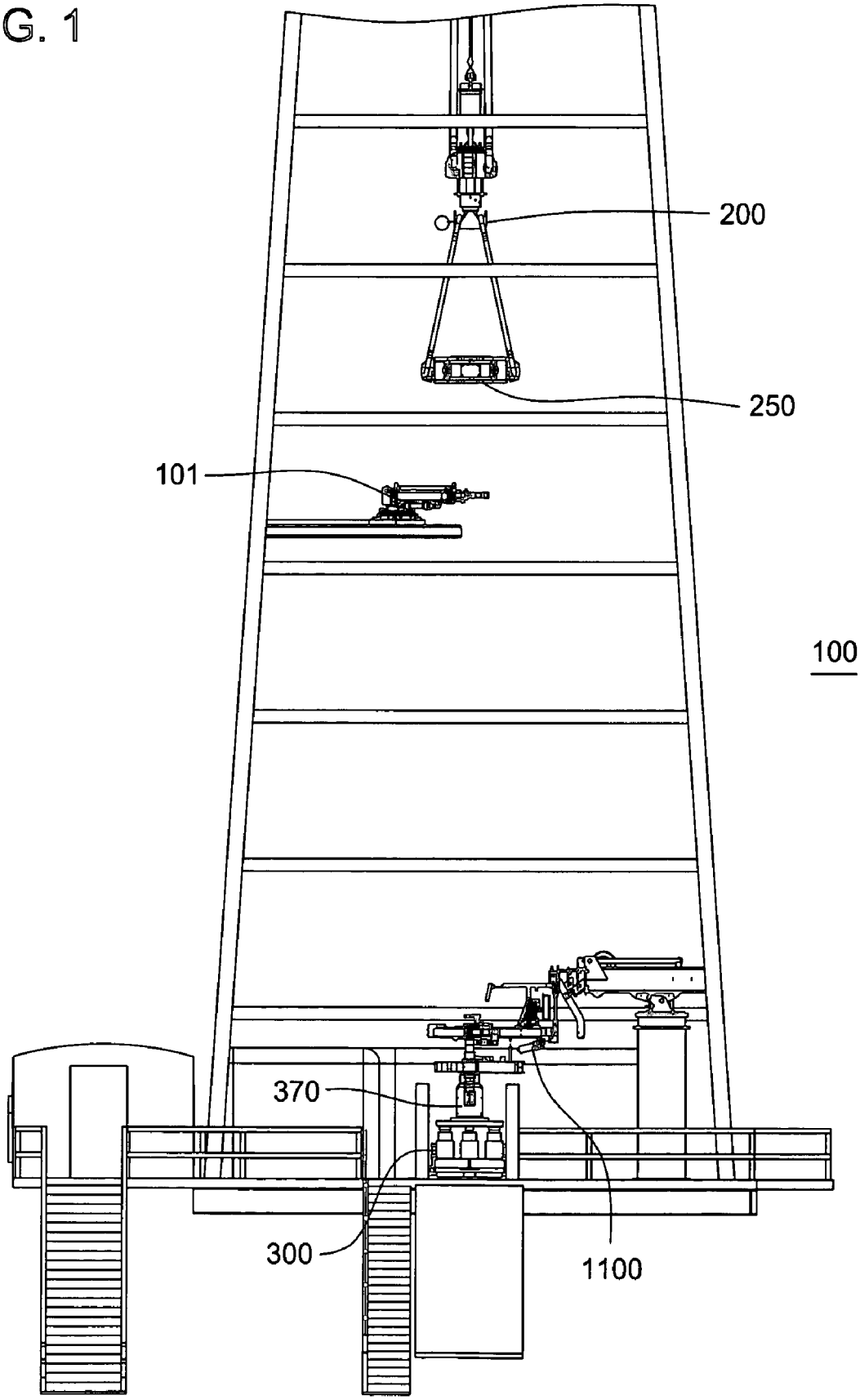
FIG. 1 is a partial view of a rig having a tubular handling system according to aspects of the present invention.

The tubular handling system includes a variety of apparatus for making or breaking the tubular connection. FIG. 1 shows a rig equipped with the tubular handling system for performing wellbore operations that involve picking up/laying down tubulars. Generally, the rig includes a traveling block suspended by cables above the rig floor. An elevator for retaining a riser section is disposed below the traveling block and is axially movable therewith. A joint compensator assembly may be disposed between the traveling block and the traveling block to compensate for the axial movement of the riser section during make up of the threaded connection.

The riser string for connection with the riser section is held in the rig floor by a spider. In one embodiment, the elevator and the spider are adapted to retain the risers without applying a radial gripping force. The rig may also include a tong assembly for rotating the riser section relative to the riser strings to complete the make up. A stabbing guide may also be used to align the riser section to facilitate the connection process.

A. Joint Compensator Assembly

Figure 2:
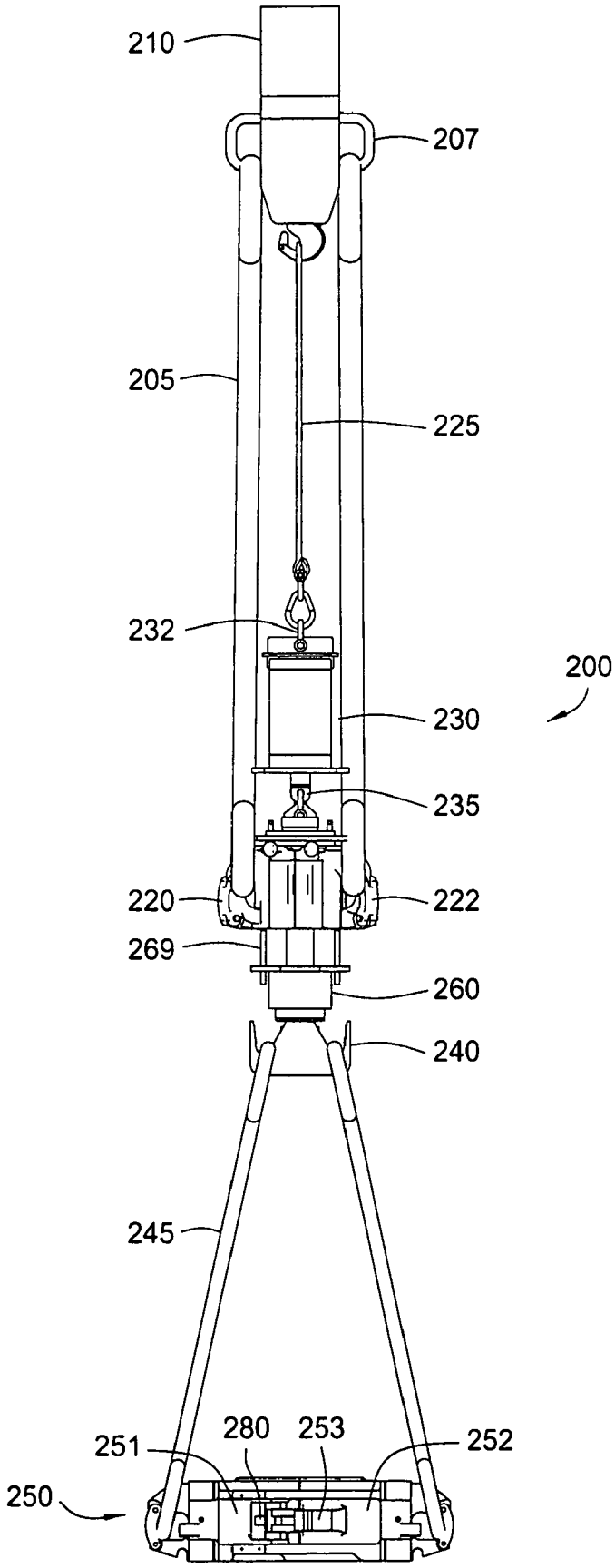
FIG. 2 is a view of a joint compensator system suspended from a traveling block.

FIG. 2 shows an exemplary joint compensator assembly 200 according to aspects of the present invention. Other suitable joint compensators are disclosed in U.S. Pat. No. 6,056,060, issued to Abrahamsen et al. and U.S. Pat. No. 6,000,472, issued to Albright et al., which patents are assigned to the same assignee of the present application and are incorporated by reference herein in their entirety. In one embodiment, the joint compensator assembly 200 includes a pair of main bails 205, or links, suspended from the lift eyes 207 of the traveling block 210. The lower ends of the main bails 205 are coupled to the lift eyes 222 of an upper elevator 220. A cable 225 extends from the lower end of the traveling block 210 and connects to a shackle 232 of the joint compensator 230. The joint compensator 230 may be any suitable joint compensator known to a person of ordinary skill in the art. Examples of the joint compensator include air cylinder compensator, hydraulic compensator, and air spring compensator. A swivel 235 interconnects the joint compensator 230 to a lift member 240 or becket. The upper end of the lift member 240 extends through the upper elevator 220 and the lower end of the lift member 240 defines a hook end that is releasably connected to two support links 245, which are adapted to support the lower elevator 250. The outer diameter of the upper end of the lift member 240 above the upper elevator 220 is sufficiently sized such that it will not pass through the upper elevator 220. In this respect, the upper elevator 220 may be lifted to contact the bottom portion of the upper end of the lift member 240, thereby transferring the load of the riser from the lift member 240 to the upper elevator 220.

Figure 3:
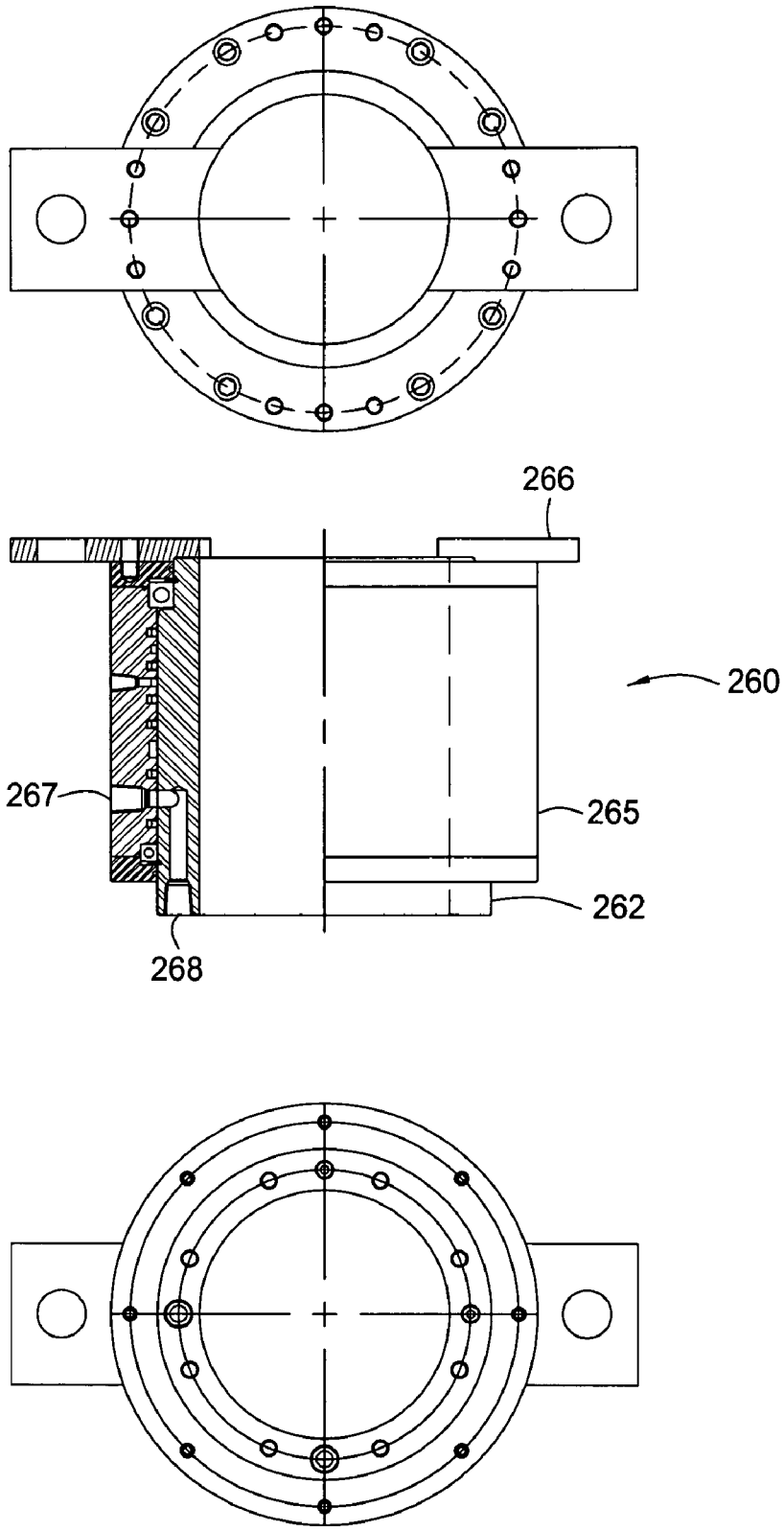
FIG. 3 is a partial cross-sectional view of a rotary seal suitable for use with the joint compensator system of FIG. 2.

In one aspect, the joint compensator assembly 200 includes a rotary seal 260 disposed between the upper elevator 220 and the hook end of the lift member 240. Any suitable rotary seal known to a person of ordinary skill in the art may be used. FIG. 3 shows an exemplary rotary seal 260 according to aspects of the present invention. The rotary seal 260 includes an inner tubular body 262 concentrically disposed within an outer tubular body 265. The outer body 265 is formed by connecting two outer body portions. Two flanges 266 are attached to the upper portion of the outer body 265 to allow the outer body 265 to be connected to the upper elevator 220 using one or more links 269. Because it is connected to the upper elevator 220, the outer body 265 is non-rotational during make up. On the other hand, the inner body 262 is attached to the lift assembly 240, which causes the inner body 262 to rotate with the lower elevator 250 during make up.

The rotary seal 260 provides a method for communication with the lower elevator 250. For example, control lines may attach to ports 267 formed in the outer body 265 of the rotary seal 260. Each of the outer ports 267 is communicable with a mating port 268 in the inner body 262. Particularly, the ports 267, 268 are adapted to allow fluid communication between the outer body 265 and the inner body 262 even though the inner body 262 is rotating relative to the outer body 265. Additional control lines are provided to interconnect the mating ports 268 exiting the inner body 262 to the lower elevator 250. In this manner, the addition of the rotary seal 260 to the joint compensator assembly 200 allows signal transmission to and from the lower elevator 250.

Control lines attached to the lower elevator 250 may be used to operate the lower elevator 250. As shown, the lower elevator 250 is a side door elevator. The lower elevator 250 includes two side doors 251, 252 hingedly attached to the body of the elevator 250. A latch 253 is used to keep the side doors 251, 252 closed. The side doors 251, 252 and the latch 253 may be operated by one or more cylinder assemblies (not shown). The cylinder assemblies are controlled by signals transmitted through the control lines. The cylinder assemblies may be actuated using any suitable manner known, including electrics, mechanics, or fluids such as hydraulics and, preferably, pneumatics. Pneumatic fluid sent through the rotary seal 260 and the control lines may sequentially release the latch 253 and open the side doors 251, 252 to receive a riser section. Specifically, the cylinder assemblies pivot the side doors 251, 252 outward to enable the riser to pass between the side doors 251, 252. In this manner, the rotary seal 260 allows the lower elevator 250 to be remotely controlled or operated.

B. Elevator and Spider Assembly

Figure 4:
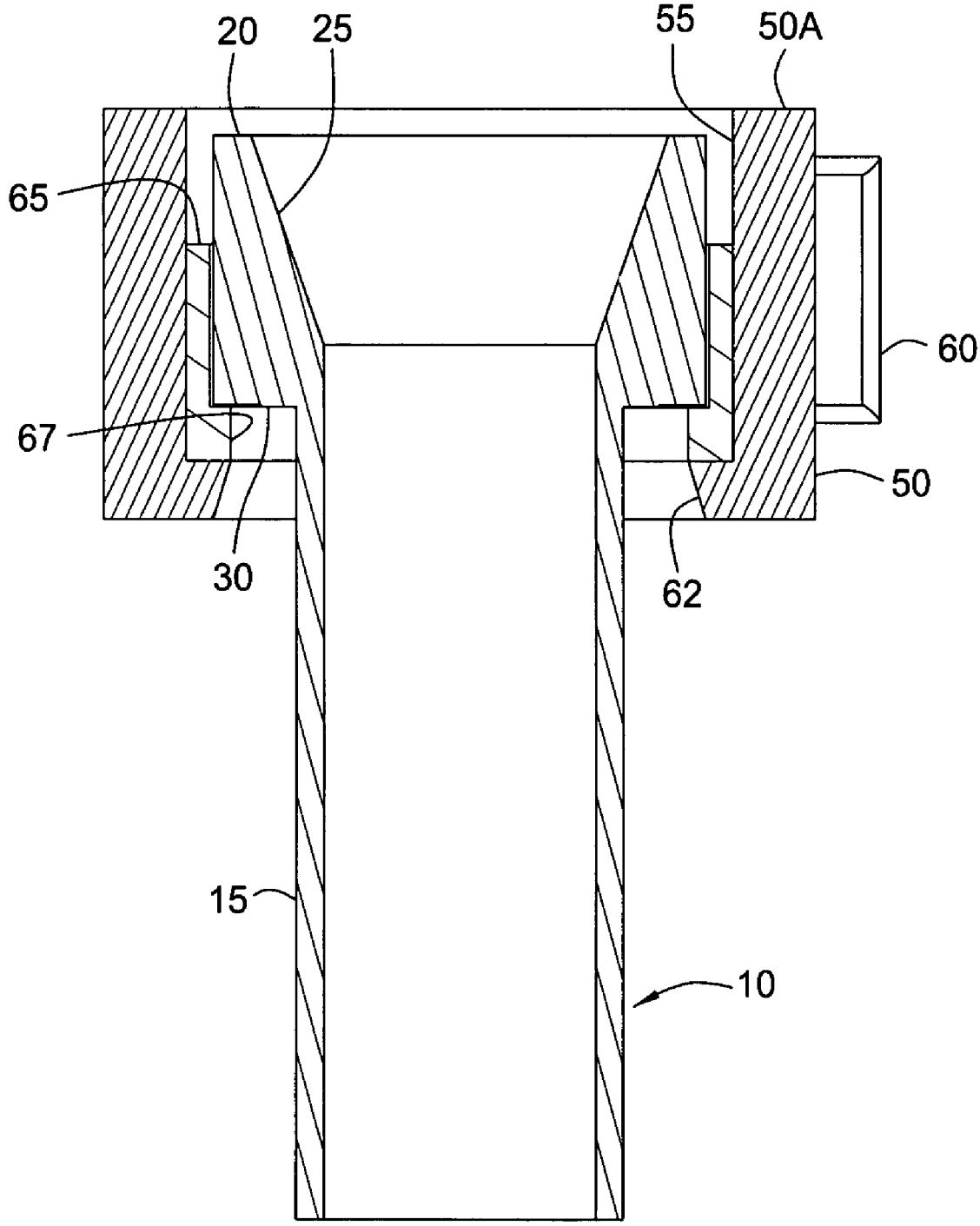
FIG. 4 is a cross-sectional view of a riser supported by an elevator according to aspects of the present invention.

In another aspect, the lower elevator is used in combination with a spider to handle a riser 10. As shown in FIG. 4, the riser 10 includes a riser body 15 and an upset member 20. The upset member 20 contains the connector 25 for connection with another riser. As such, the upset member 20 has a larger outer diameter than the outer diameter of the riser body 15. It is understood that the upset member 20 may attach to the tubular body 15 or formed integral thereto.

Figure 5:
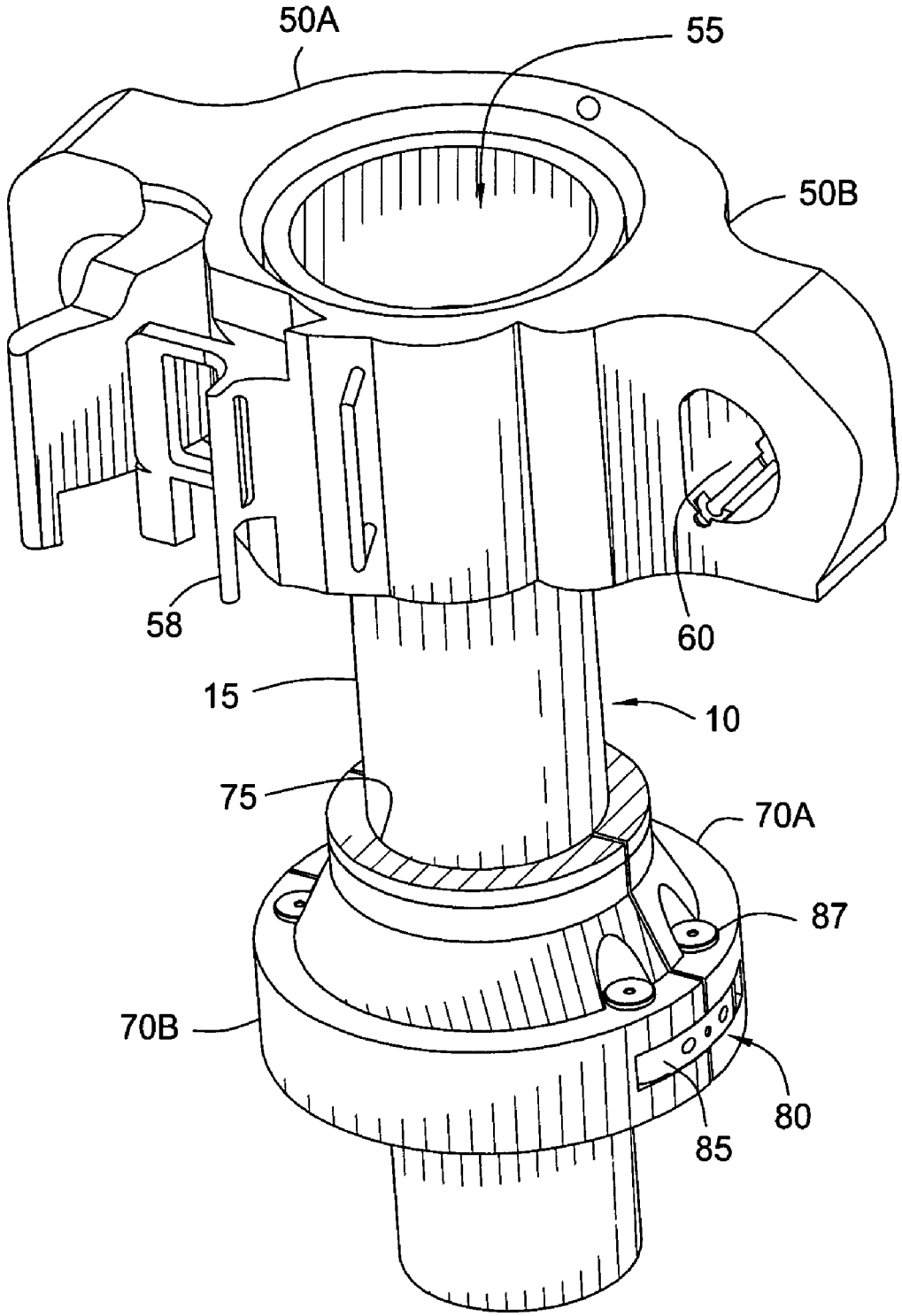
FIG. 5 is an isometric view of a riser supported by a tubular handling system according to aspects of the present invention.

In one embodiment, the elevator 50 and spider 70 combination is adapted to take advantage of the large upset member 20 of the riser 10 as illustrated in FIG. 5. The elevator 50 defines two half portions 50A, 50B operatively hinged together and having a bore 55 therethrough. Suitable elevators include an elevator 50 hinged on one side and having a latch 58 on another side. Alternatively, an elevator 50 designed to open on two different sides, such as having a hinge on two sides, may be employed. Preferably, the elevator 50 is a fluidly operated side door elevator 250 as shown in FIG. 2. The elevator 50 includes two lift eyes 60 for attachment to a conveying member, such as a bail 245, whereby the elevator 50 may be axially translated.

Referring to FIG. 4, the elevator 50 includes a support shoulder 62 to retain an elevator bushing 65. The elevator bushing 65 is partially disposed between the upset member 20 and the elevator 50 to center the upset member 20 in the elevator 50. The elevator bushing 65 also includes a riser support 67 adapted to engage a lower end 30 of the upset member 20. The riser support 67 is adapted to only contact an outer portion of the lower end 30 of the upset member 20. In this respect, elevator 50 engages the outer portion to support the weight of the riser 10, while leaving an inner portion of the lower end 30 of the upset member 20 unengaged. In this manner, the elevator 50 may support and axially translate the riser 10. Preferably, the end of the support shoulder 62 of the elevator 50 is beveled to facilitate the positioning of the spider 70 into contact with the inner portion of the upset member 20. It must be noted that aspects of the present invention are equally applicable to an elevator not equipped with the elevator bushing 65. For example, the support shoulder 62 of the elevator 50 may be adapted to directly engage the upset member 20, thereby supporting the riser 10 without the elevator bushing 65.

Referring to FIG. 5, the spider 70 is adapted to engage the inner portion of the lower end 30 to support the weight of the riser 10. The spider 70 is located on the rig floor and defines two half portions 70A, 70B operatively coupled together and having a bore 75 therethrough, as illustrated in FIG. 5. In one embodiment, a dual hinge connection 80 is disposed on opposite sides of the spider 70. The dual hinge connection 80 includes a plate 85 that couples the two portions 70A, 70B of the spider 70. A hinge pin 87 is used to movably connect each portion 70A, 70B to the plate 85, thereby allowing each portion 70A, 70B to pivot relative to the plate 85. The hinge pin 87 is removed to open the spider 70. Having a dual hinge connection 80 on each side allows the spider 70 to open on two different sides. It is understood that a single hinge connection may also be used, as well as a spider 70 that opens only from one side, without deviating from aspects of the present invention.

Figure 6:
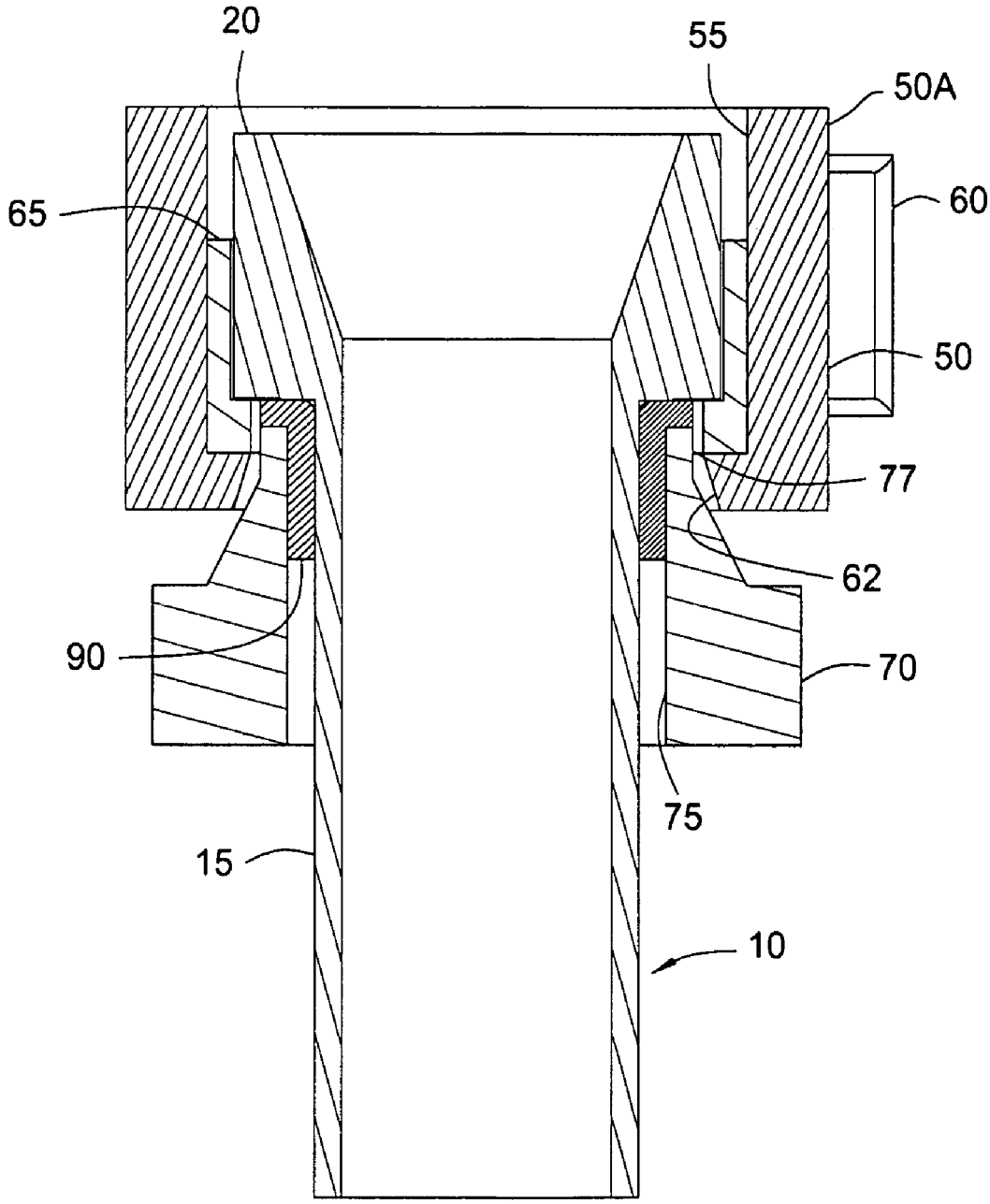
FIG. 6 is a cross-sectional view of a riser supported by a tubular handling system according to aspects of the present invention.

As shown in FIG. 6, an upper portion 77 of the spider 70 has an outer diameter that is about the same or smaller than the outer diameter of the unengaged inner portion of the upset member 20. Additionally, the upper portion 77 of the spider 70 is size to fit between the riser support 67 of the elevator 50 and the riser body 15, thereby allowing the elevator 50 and the spider 70 to engage the upset member 20 at the same time.

Figure 7:
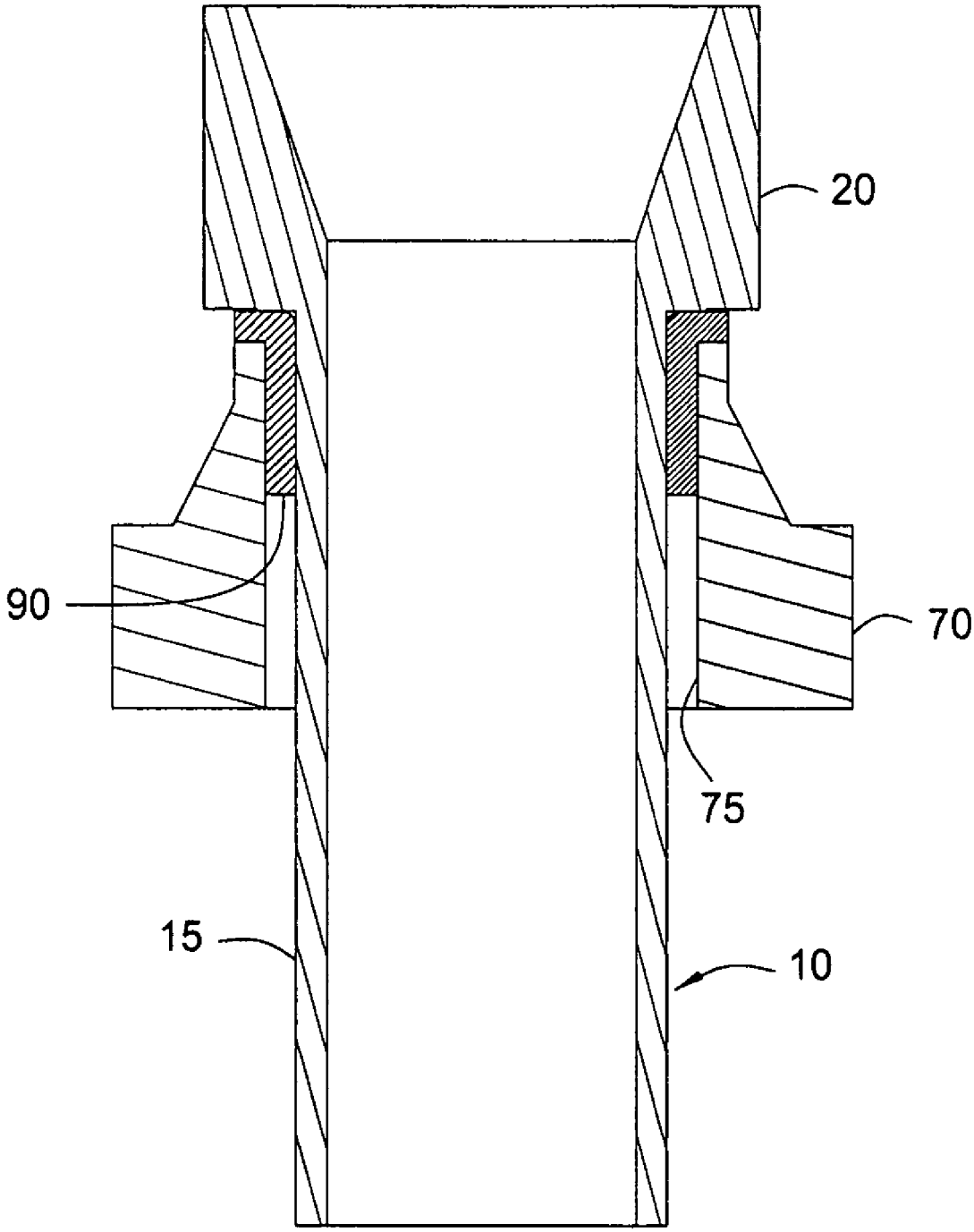
FIG. 7 is a cross-sectional view of a riser supported by a spider according to aspects of the present invention.

In another embodiment, the spider 70 may employ a spider bushing 90 to center the riser 10 within the bore 75 of the spider 70, as illustrated in FIG. 7. As shown, a portion of the spider bushing 90 is disposed between the riser 10 and the interior of the spider 70. The spider bushing 90 may have a ledge at one end to seat above the upper portion of the spider 70. The ledge of the spider bushing 90 has an outer diameter that is about the same or smaller than the outer diameter of the unengaged inner portion of the upset member 20. In this respect, the spider bushing 90 also allows the spider 70 and the elevator 50 to engage the riser 10 at the same time.

In operation, the elevator 50 is suspended by bails 245 above the spider 70 disposed on the rig floor. As shown in FIG. 5, the riser 10 is supported by the elevator 50, and a portion of the riser body 15 is disposed through the bore 75 of the spider 70. Particularly, the elevator 50 is closed around the upset member 20 of the riser 10, and the elevator bushing 65 is employed to center the riser 10 in the elevator 50 as illustrated in FIG. 4. In addition, the riser support 67 of the elevator bushing 65 is engaged with the outer portion of the lower end 30 of the upset member 20. In this position, the elevator 50 may be caused to axially translate the riser 10 relative to the spider 70.

Referring to FIG. 6, the riser 10 is lowered toward the spider 70 until the inner portion of the upset member 20 engages the spider bushing 90. The beveled support shoulder 62 facilitates the insertion of the spider 70 if the spider 70 and the elevator 50 is slightly out of alignment. As illustrated, the elevator 50 and the spider 70 are adapted to allow the elevator 50 to partially encircle the spider 70, thereby allowing the elevator 50 and the spider 70 to engage the upset member 20 at the same time. In this position, either the elevator 50 or the spider 70 or both may support the riser 10 in the wellbore. Thereafter, the elevator 50 is opened to disengage from the riser 10, thereby transferring the load of the riser 10 entirely onto the spider 70.

The elevator 50 may now retrieve and position a second riser for connection with the riser 10 in the spider 70. After the risers have been connected, the elevator 50 may raise the risers relative to the spider 70 to transfer the load back to the elevator 50. Then the spider 70 is opened sufficiently to allow the riser 10 to be lowered into the wellbore. Once the upset member 20 has passed through the spider 70, the spider 70 is closed around the riser body of the second riser. Thereafter, the upset member of the second riser is lowered into engagement with the spider 70. This cycle of handling risers may be repeated to add additional risers. Because the elevator 50 and the spider 70 do not retain the riser 10 by gripping the riser body 15, the present invention provides methods and apparatus for handling risers without damaging the outer surface of the riser body.

C. Shock Table

Figure 8:
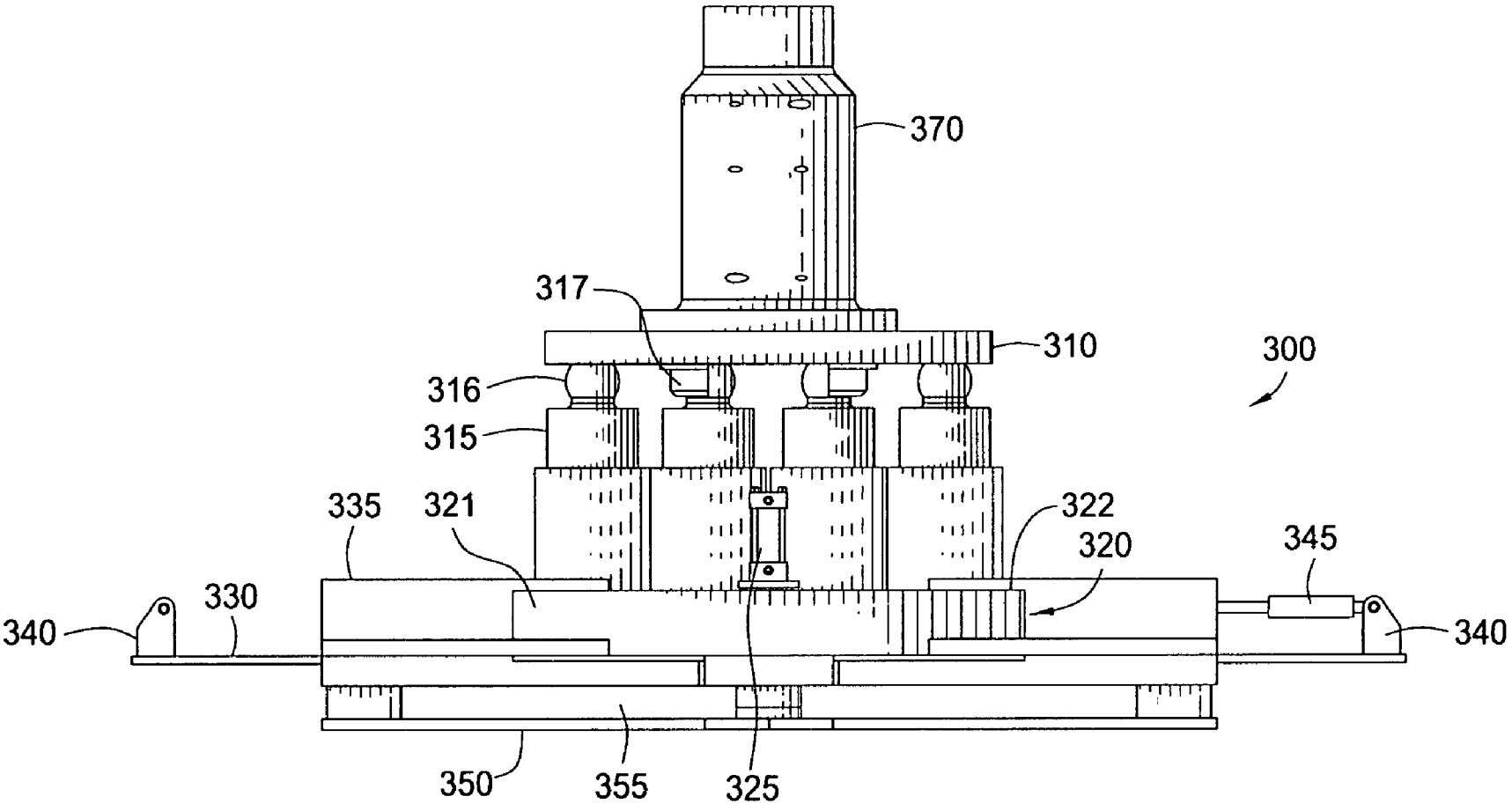
FIG. 8 shows a rotary table for supporting a spider according to aspects of the present invention.
Figure 9:
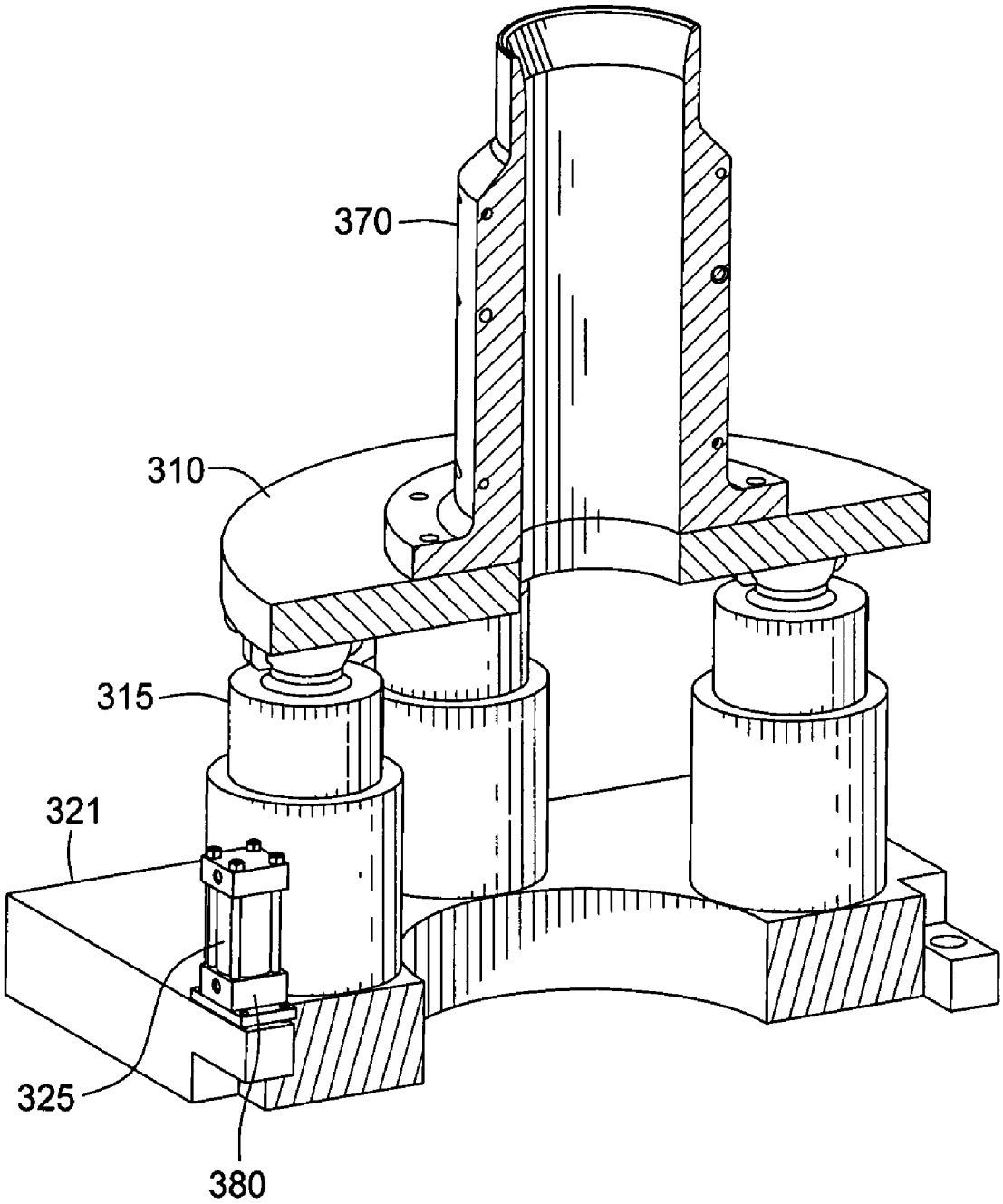
FIG. 9 is a partial view of the rotary table of FIG. 8.

In another aspect, the tubular handling system 100 provides a rotary table 300 to support the spider 370 on the rig floor. Preferably, the rotary table 300 is adapted to absorb the shock experienced by the spider 370. FIG. 8 shows an exemplary rotary table 300 applicable to running risers. As shown, the spider 370 is attached to a support plate 310, which sits above a plurality of compensating cylinder assemblies 315. The cylinder assemblies 315 are disposed on a base 320 formed by two selectively connected base portions 321, 322. FIG. 9 illustrates one of the base portions 321. The two base portions 321, 322 are selectively connected using a remotely controllable pin 325 inserted through the two base portions 321, 322. The cylinder assemblies 315 are adapted to compensate for shock and for any rig movement. In one embodiment, the cylinder assemblies 315 are interconnected and connected to an accumulator. The pressure in the accumulator is regulated with respect to the string weight to promote the optimal compensation. For example, as the rig moves or sways, each of the cylinders 315 may extend or retract to compensate for the rig movement, thereby keeping the support plate 310 horizontally leveled. To facilitate compensation, the upper end 316 of the cylinder assembly 315 is rounded and mates with an arcuate inner surface of a cap 317 disposed between the cylinder assembly 315 and the support plate 310. Relative pivotal movement is allowed by the arcuate inner surface when the respective cylinder 315 is compensating for shock or rig movement.

The base 320 is movably disposed on a shock table 330. Each side of the base 320 may include a base extension 335 that is connected to anchors 340 disposed at each end of the shock table 330. Preferably, a cylinder assembly 345 is used to connect the base extension 335 to the anchors 340. Actuation of the cylinder assemblies 345 moves the respective base portions 321, 322 to and from the well center, thereby allowing the riser to move axially in the wellbore. The shock table 330 includes a hole that is sufficiently sized to accommodate axial movement of the riser without opening or closing. In this respect, the base portions 321, 322 move along the shock table 330 during operation. Attached below the shock table 330 is a cushion plate 350 and a shock absorbing layer 355 disposed therebetween. In one embodiment, the shock absorbing layer 355 defines a polyurethane layer. The shock absorbing layer 355 provides additional shock absorbing capability to the shock table 330.

In another aspect, the shock table 330 may be flushed mounted. For example, the support plate 310 may be disposed directly on the shock table 330, and the compensating cylinder assemblies 315 disposed below shock table 330. In this respect, the operating height of the spider 370 is reduced, thereby allowing easier access to the spider 370.

Figure 10:
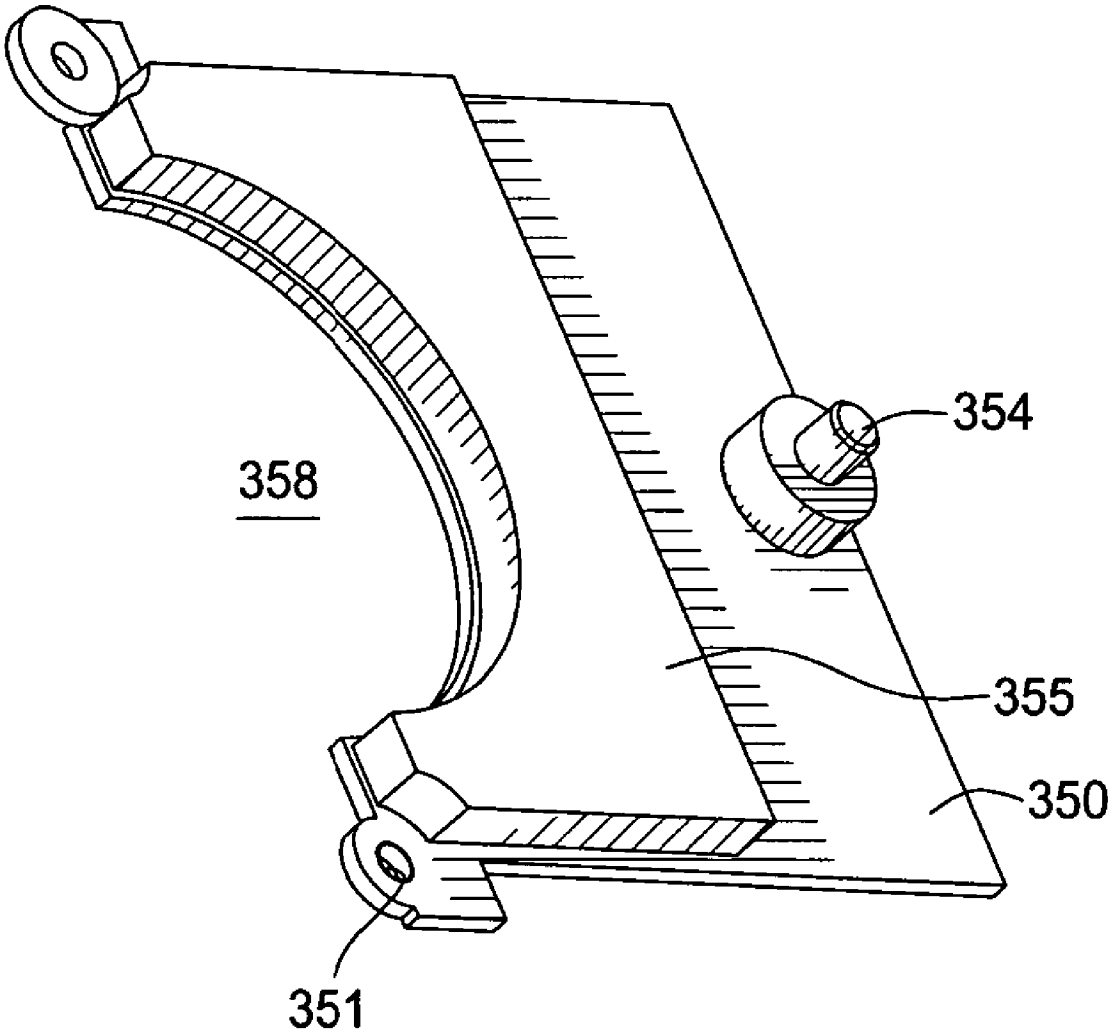
FIG. 10 is another embodiment of a rotary table according to aspects of the present invention.

In another aspect, the spider 370 may site directly on the polyurethane layer 355 and the cushion plate 350. FIG. 10 shows a partial view of the simplified rotary table 300. The cushion plate 350 comprises two body portions secured together using a remotely controllable pin, which is inserted through the pin holes 351 on each side of the rotary table 300. Each half of the spider 370 sits on a respect body portion of the rotary table 300. Support members 354 such as pins are disposed at each end of the cushion plate 350 to provide support to the spider 370 or extensions thereof. A tubular hole 358 is formed through the rotary table 300 to accommodate the riser. The rotary table 300 may be closed to support the riser or opened to allow passage of the riser through the rotary table 300.

Figure 11:
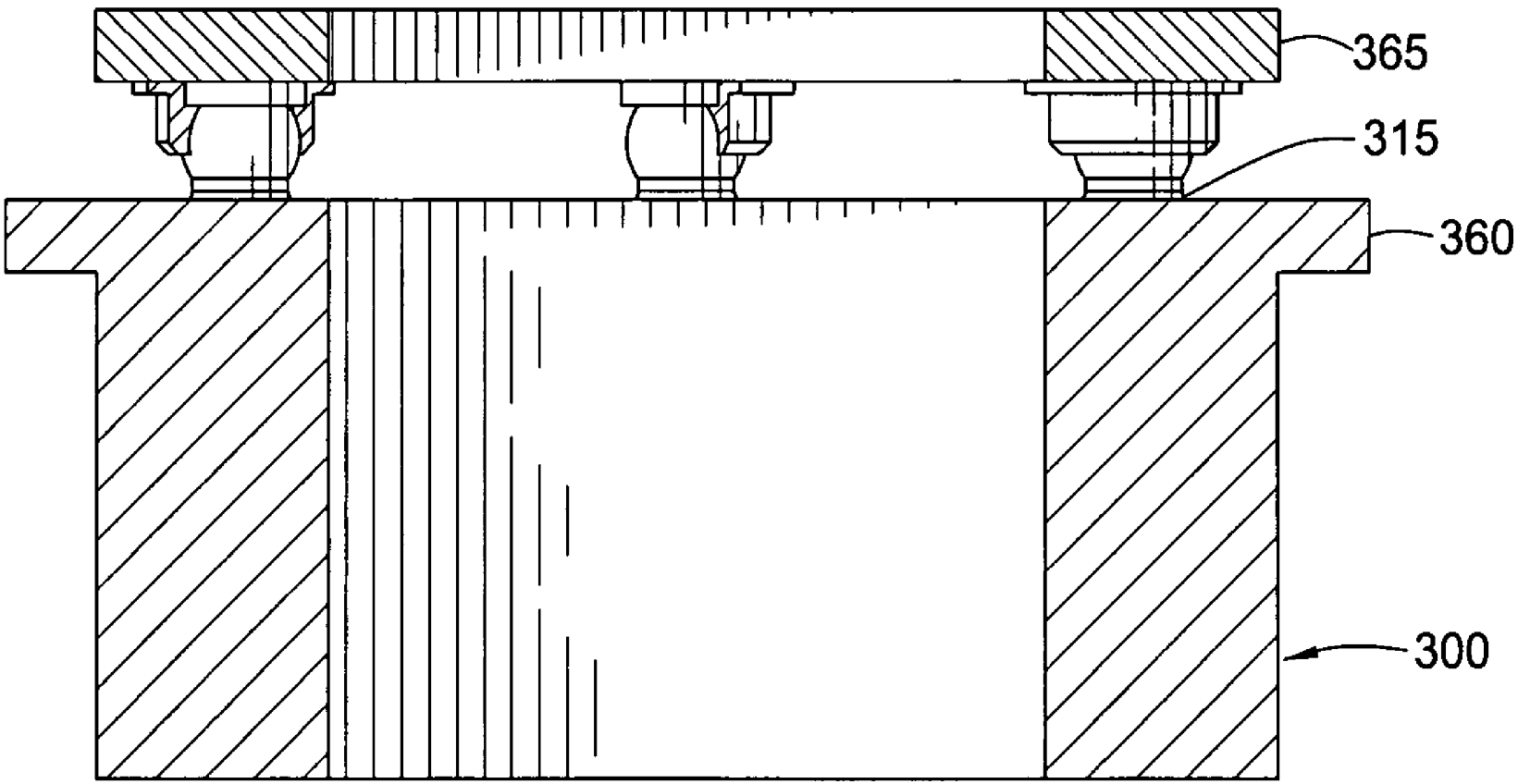
FIG. 11 is another embodiment of a rotary table according to aspects of the present invention.

FIG. 11 partially shows another embodiment of a flush mounted rotary table 300. In this embodiment, the compensating cylinder assemblies 315 are at least partially disposed within the wall 360 of the rotary table 300. The spider 370 may be disposed on a support plate 365 that is operatively connected to the cylinder assemblies 315. The wall 360 of the rotary table 300 may be at least partially disposed in the rig floor to lower the operating height of the spider 370.

D. Interlock System

In another aspect, the tubular handling system 100 includes an interlock system to insure the riser is retained by at least the spider 370 or the elevator 250. A suitable interlock system is disclosed in U.S. patent application Ser. No. 10/625,840, filed on Jul. 23, 2003, which application is assigned to the same assignee of the present invention and is herein incorporated by reference in its entirety. In one embodiment, the elevator 250 includes an elevator latch sensor 280 (FIG. 8) located at the latch 253 to detect when the elevator 250 is opened or closed. Similarly, the spider 370 includes a spider piston sensor 380 (FIG. 9) located at the remotely controllable pin 325 to detect when the spider 370 is opened or closed. Sensor data from the sensors 280, 380 are transmitted to a controller 390. Preferably, sensor data 512 from the elevator latch sensor 280 are transmitted to the controller 390 using the control lines connected to the rotary seal 260 of joint compensator assembly 200. In this respect, the rotary seal 260 advantageously allows the remote operation of the elevator 250. It must be noted that the sensors may be placed at any suitable location known to a person of ordinary skill in the art so long as they can detect the status of the elevator or spider. For example, a sensor may be placed at the cylinder assemblies responsible for opening and closing the elevator 250, or a sensor may be placed at the cylinders 345 for opening or closing the spider 370.

The controller 390 includes a programmable central processing unit that is operable with a memory, a mass storage device, an input control unit, and a display unit. Additionally, the controller 390 includes well-known support circuits such as power supplies, clocks, cache, input/output circuits and the like. The controller 390 is capable of receiving data from sensors and other devices and capable of controlling devices connected to it.

One of the functions of the controller 390 is to prevent the opening of the spider 370 and the lower elevator 250 at the same time. Preferably, the spider 370 is locked in the closed position by a solenoid valve that is placed in the control line for the source of fluid power operating the remotely controllable pin 325. Similarly, the elevator 250 is locked in the closed position by another solenoid valve that controls the fluid source to the cylinder assemblies actuating the elevator latch 253. The solenoid valves are operated by the controller 390, which is programmed to keep the valves closed until certain conditions are met. Although electrically operated solenoid valves are preferred, the solenoid valves may be fluidly or pneumatically operated so long as they are controllable by the controller 390. Generally, the controller 390 is programmed to keep the spider 370 locked until the riser is successfully joined to the riser string and supported by the elevator 250.

Figure 12:
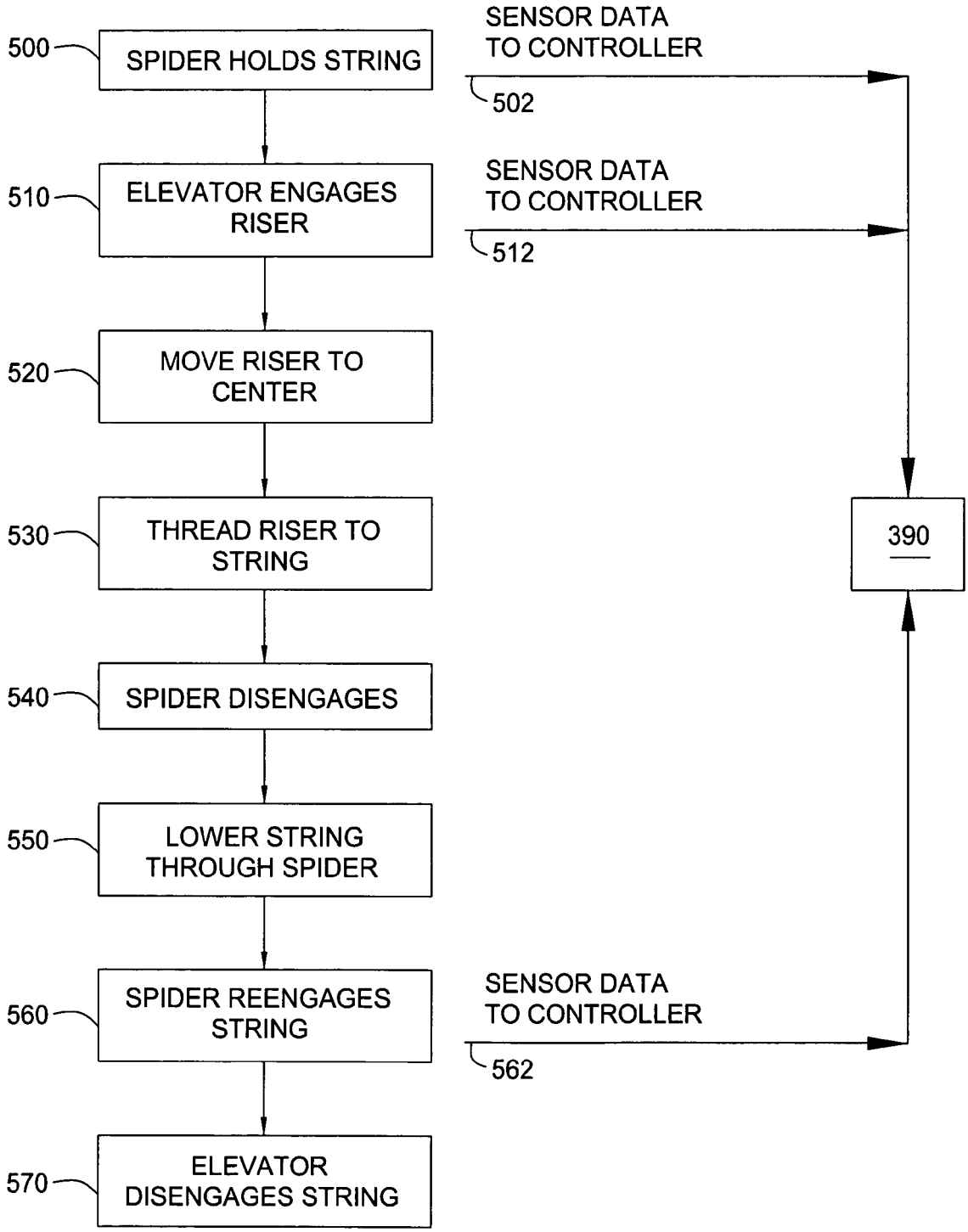
FIG. 12 is a flow chart illustrating an exemplary interlock system according to aspects of the present invention.

FIG. 12 is a flow chart illustrating an exemplary interlock system for use with the spider 370 and the elevator 250 to connect one or more risers. Initially, at step 500, the riser string is retained in the wellbore and prevented from axial movement by the spider 370. Sensor data 502 from the spider piston sensor 380 indicating that the spider 370 is closed is transmitted to the controller 390. At step 510, the elevator 250 is moved to engage a riser section to be connected with the riser string. When the elevator 250 is closed around the riser section, the sensor 280 sends a signal 512 to the controller 390.

At step 520, the riser section is moved to the well center for connection with the riser string. A tubular guide member is used to align riser section with the riser string. Next, at step, 530, a tong is moved into position to connect the riser section to the riser string. After the connection is completed, at step 540, the spider 370 disengages from the riser string. At step 550, the extended riser string is then lowered through the spider 370. Thereafter, at step 560, the spider 370 reengages the riser string. After engagement, at step 560, the spider piston sensor 380 transmits the sensor data 562 to the controller 390. After receiving the sensor data 562 indicating that the spider 370, the controller 390 allows the elevator 250 to disengage from the riser string and pick up another riser for connection with the riser string.

E. Tubular Guide Member

In another aspect, the tubular handling system 100 includes a tubular guide member 101 for guiding the riser section into alignment with the riser string, as shown in FIG. 1. A suitable tubular guide member 101 is disclosed in U.S. patent application Ser. No. 10/794,797, filed on Mar. 5, 2004, which application is herein incorporated by reference in its entirety. FIGS. 13-14 depict an exemplary tubular guide member 101 according to aspects of the present invention. FIG. 13 presents a top view of the tubular guide member 101, while FIG. 14 presents a cross-sectional view of the tubular guide member 101 along line A-A. The tubular guide member 101 includes a base 105 at one end for attachment to the rig. The gripping member 150 is disposed at another end, or distal end, of the tubular guide member 101. A rotor 110 is rotatably mounted on the base 105 and may be pivoted with respect to the base 105 by a piston and cylinder assembly 131. One end of the piston and cylinder assembly 131 is connected to the base 105, while the other end is attached to the rotor 110. In this manner, the rotor 110 may be pivoted relative to the base 105 on a plane substantially parallel to the rig floor upon actuation of the piston and cylinder assembly 131. In another embodiment, the tubular guide member 101 may be disposed on a rail such that it may move axially relative to the rig.

A conveying member 120 interconnects the gripping member 150 to the rotor 110. In one embodiment, two support members 106, 107 extend upwardly from the rotor 110 and movably support the conveying member 120 on the base 105. Preferably, the conveying member 120 is coupled to the support members 106, 107 through a pivot pin 109 that allows the conveying member 120 to pivot from a position substantially perpendicular to the rig floor to a position substantially parallel to the rig floor. Referring to FIG. 14, the conveying member 120 is shown as a telescopic arm. A second piston and cylinder assembly 132 is employed to pivot the telescopic arm 120 between the two positions. The second piston and cylinder assembly 132 movably couples the telescopic arm 120 to the rotor 110 such that actuation of the piston and cylinder assembly 132 raises or lowers the telescopic arm 120 relative to the rotor 110. In the substantially perpendicular position, the tubular guide member 101 is in an unactuated position, while a substantially parallel position places the tubular guide member 101 in the actuated position.

The telescopic arm 120 includes a first portion 121 slidably disposed in a second portion 122. A third piston and cylinder assembly 133 is operatively coupled to the first and second portions 121, 122 to extend or retract the first portion 121 relative to the second portion 122. In this respect, the telescopic arm 120 and the rotor 110 allow the tubular guide member 101 to guide the riser into alignment with the riser in the spider 370 for connection therewith. Although a telescopic arm 120 is described herein, any suitable conveying member known to a person of ordinary skill in the art are equally applicable so long as it is capable of positioning the gripping member 150 at a desired position.

The gripping member 150, also known as the "head," is operatively connected to the distal end of the telescopic arm 120. The gripping member 150 defines a housing 151 movably coupled to two gripping arms 154, 155. Referring to FIG. 13, a gripping arm 154, 155 is disposed on each side of the housing 151 in a manner defining an opening 152 for retaining a riser. Piston and cylinder assemblies 134, 135 may be employed to actuate the gripping arms 154, 155. One or more centering members 164, 165 may be disposed on each gripping arm 154, 155 to facilitate centering of the riser and rotation thereof. An exemplary centering member 164, 165 is a roller, which may include passive rollers or active rollers having a driving mechanism.

It is understood that the piston and cylinder assemblies 131, 132, 133, 134, and 135 may include any suitable fluid operated piston and cylinder assembly known to a person of ordinary skill in the art. Exemplary piston and cylinder assemblies include a hydraulically operated piston and cylinder assembly and a pneumatically operated piston and cylinder assembly.

In another aspect, the gripping member 150 may be equipped with a spinner 170 to rotate the riser retained by the gripping member 150. As shown in FIG. 14, the spinner 170 is at least partially disposed housing 151. The spinner 170 includes one or more rotational members 171, 172 actuated by a motor 175. The torque generated by the motor 175 is transmitted to a gear assembly 178 to rotate the rotational members 171, 172. Because the rotational members 171, 172 are in frictional contact with the riser, the torque is transmitted to the riser, thereby causing rotation thereof. In one embodiment, two rotational members 171, 172 are employed and equidistantly positioned relative to a central axis of the gripping member 150. An exemplary rotational member 171 includes a roller. Rotation of the riser will cause the partial make up of the connection between the risers. In another aspect, a rotation counting member 180 may optionally be used to detect roller slip. The rotation counting member 180 includes an engagement roller 183 biased by a biasing member 184. It is understood that the operation may be reversed to break out a tubular connection.

A valve assembly 190 is mounted on the base 105 to regulate fluid flow to actuate the appropriate piston and cylinder assemblies 131, 132, 133, 134, 135 and motor 175. The valve assembly 190 may be controlled from a remote console (not shown) located on the rig floor. The remote console may include a joystick which is spring biased to a central, or neutral, position. Manipulation of the joystick causes the valve assembly 190 to direct the flow of fluid to the appropriate piston and cylinder assemblies. The tubular guide member 101 may be designed to remain in the last operating position when the joystick is released.

In another aspect, the tubular guide member 101 may include one or more sensors to detect the position of the gripping member 150. An exemplary tubular guide member having such a sensor is disclosed in U.S. patent application Ser. No. 10/625,840, filed on Jul. 23, 2003, assigned to the same assignee of the present invention, which application is incorporated by reference herein in its entirety. In one embodiment, a linear transducer may be employed to provide a signal indicative of the respective extension of piston and cylinder assemblies 131, 133. The linear transducer may be any suitable liner transducer known to a person of ordinary skill in the art, for example, a linear transducer sold by Rota Engineering Limited of Bury, Manchester, England. The detected positions may be stored and recalled to facilitate the movement of the riser. Particularly, after the gripping member 150 has place the riser into alignment, the position of the gripping member 150 may be determined and stored. Thereafter, the stored position may be recalled to facilitate the placement of additional risers into alignment with the riser string.

F. Tong

In another aspect, a tong may be remotely operated to connect the risers. An exemplary tong is disclosed in U.S. patent application Ser. No. 10/794,792, filed on Mar. 5, 2004, which application is assigned to the same assignee as the present invention and is herein incorporated by reference in its entirety.

Figure 15:
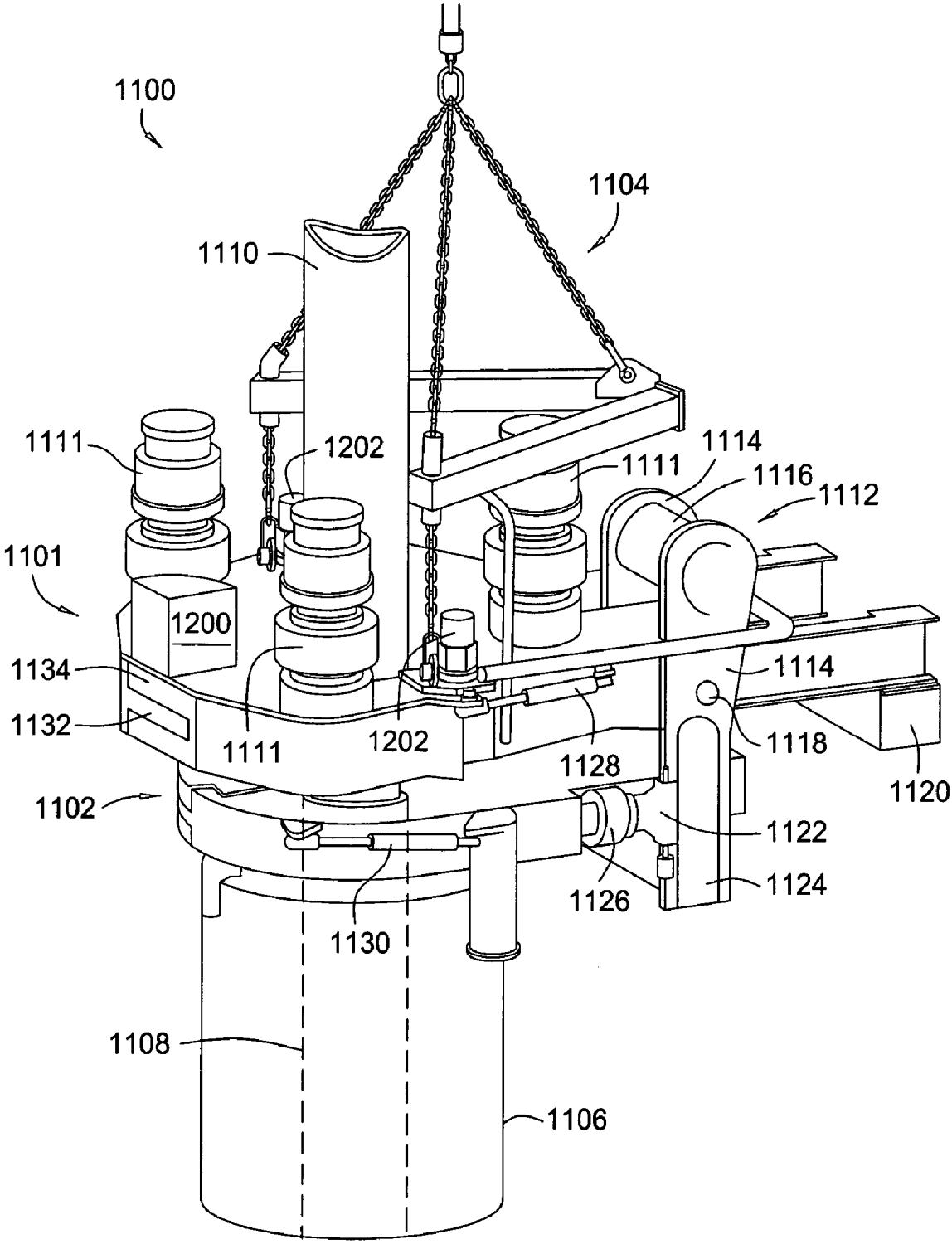
FIG. 15 is a view of an embodiment of a tong assembly in operation with a tubular string positioned therein.

FIG. 15 illustrates an embodiment of a tong assembly 1100 suitable for connecting the risers. The tong assembly 1100 includes a power tong 1101 disposed above a back up tong 1102. In operation, the tong assembly 1100 suspends from a handling tool 1104 that positions the tong assembly 1100 around a tubular of a tubular string such as a lower tubular 1108 held by a spider 1106 and a stand or upper tubular 1110. As described in more detail below, the power tong 1101 grips the upper tubular 1110 and the back up tong 1102 grips the lower tubular 1108. Three drive motors 1111 operate to provide torque to the power tong 1101 to rotate the upper tubular 1110. In one embodiment, the tong assembly may apply 1,300,000 foot pounds of torque to a riser thread connection in a riser string that is about twenty inches in diameter.

Each of the tongs 1101, 1102 are segmented into three segments such that the front two segments pivotally attach to the back segment and enable movement of the tongs 1101, 1102 between an open and a closed position. In the open position, the front sections pivot outward enabling the tubulars 1108, 1110 to pass between the front sections so that the handling tool 1104 can align the tubulars 1108, 1110 within the tongs 1101, 1102. The tongs 1101, 1102 move to the closed position as shown in FIG. 15 prior to make up or break out operations. Pistons 181128 (only one piston is visible) on each side of the power tong 1101 operate to pivot the front segments relative to the back segment in order to open and close a gate between the front segments that is formed where an extension 1132 on one of the front segments mates with a corresponding grooved portion 1134 of the other front section. Similarly, pistons 1130 (again only one piston is visible) on each side of the back up tong 1102 operate to pivot the front segments relative to the back segment in order move the back up tong between the open and closed position. The pistons 181128, 1130 may be operated by a tong assembly hydraulic circuit that supplies fluid pressure to various components of the tong assembly 1100 through a common pressure source. As with all other components of the tong assembly 1100 operated by the tong assembly hydraulic circuit, automated or manually operated valves (not shown) may be used to separately or in combination open and close fluid supply to each component (e.g. the pistons 181128, 1130) at the desired time.

A torque bar assembly 1112 located adjacent a counterweight 1120 connects the power tong 1101 to the back up tong 1102. The torque bar assembly 1112 includes two arms 1114 extending downward from each end of a horizontal top bar or suspension 1116. A back end of the power tong 1101 connects to a horizontal shaft 1118 that extends between the arms 1114 below the suspension 1116. The shaft 1118 may fit within bearings (not shown) in the arms 1114 to permit pivoting of the power tong 1101 relative to the torque bar assembly 1112. Damping cylinders 1400 (shown in FIG. 18) connect between a top of the power tong 1101 and the suspension 1116 to prevent free swinging of the power tong 1101 about the shaft 1118. Clamps 1122 on the back up tong 1102 grip a longitudinal recess 1124 in the arms 1114, thereby securing the back up tong 1102 to the torque bar assembly 1112. The clamps 1122 slide along the recess 1124 to permit movement of the back up tong 1102 relative to the power tong 1101 during make up or break out operations. The torque bar assembly 1112 provides a connection between the tongs 1101, 1102 that permits the back up tong 1102 to rise into near contact with the power tong 1101.

The torque bar assembly 1112 keeps side forces out of the connection between the tubulars 1108, 1110 by eliminating or at least substantially eliminating shear and bending forces. As the power tong 1101 applies torque to the upper tubular 1110, reaction forces transfer to the torque bar assembly 1112 in the form of a pair of opposing forces transmitted to each arm 1114. The forces on the arms 1114 place the suspension 1116 in torsion while keeping side forces out of the connection. A load cell and compression link 1126 may be positioned between the clamp 1122 and back up tong 1102 in order to measure the torque between the power tong 1101 and back up tong 1102 during make up and break out operations.

Figure 16:
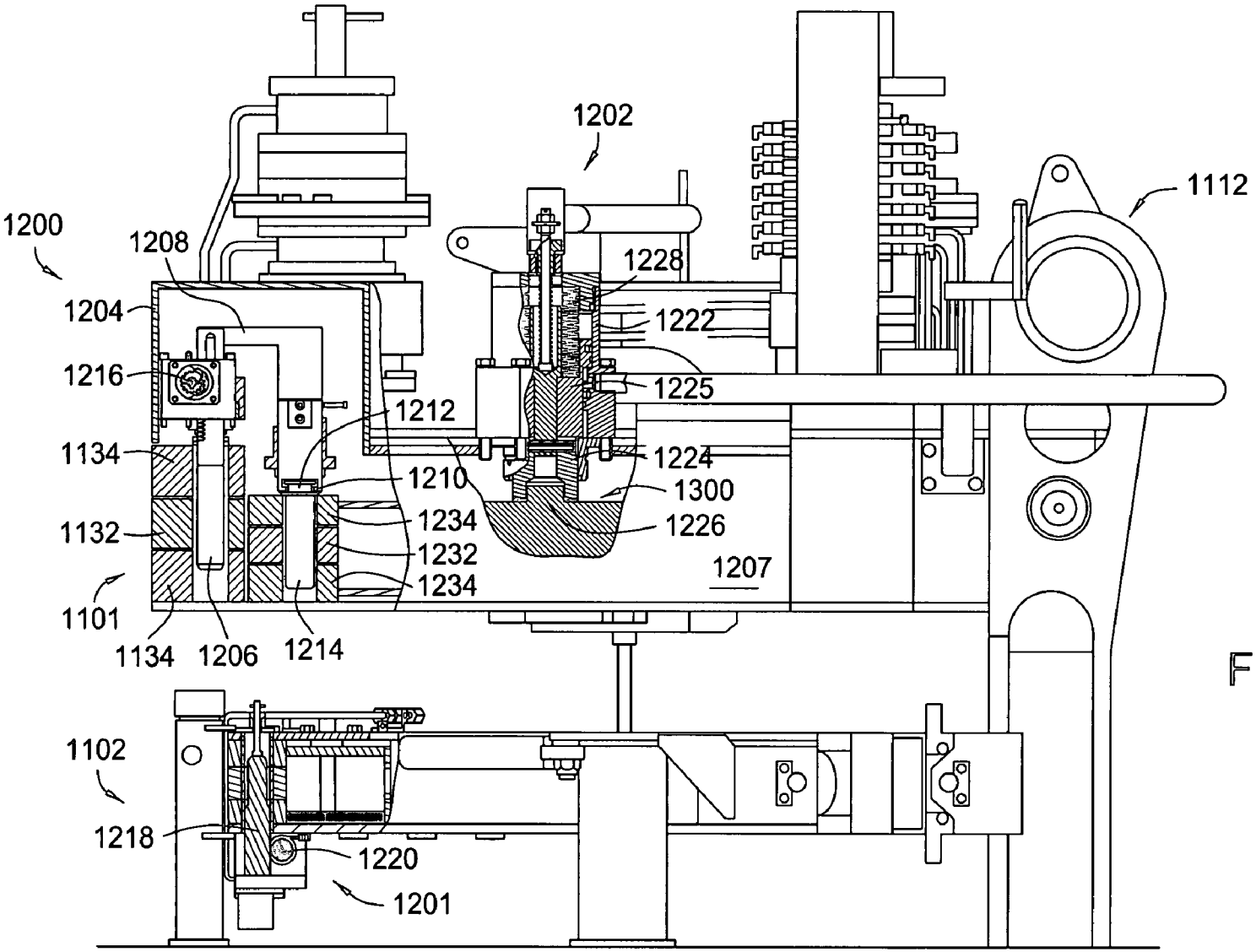
FIG. 16 is a side view of the tong assembly showing a detail of gate locks on a power tong and a back up tong and a detail of a rotor lock on the power tong.

FIG. 16 shows a side of the tong assembly 1100 and a detail of a power tong gate lock 1200, a back up gate lock 1201 and a rotor lock 1202. The gate locks 1200, 1201 lock the tongs 1101, 1102 in the closed position. The rotor lock 1202 prevents rotation of a rotor 1300 when in the open position and prevents any possible misalignment of parts of the rotor 1300 caused by moving the power tong 1101 to the open position since the rotor may be forced outward in the open position. Thus, the rotor lock 1202 maintains the rotor 1300 in position and prevents rotation of the rotor 1300 until the rotor lock 1202 is actuated.

The power tong gate lock 1200 includes an outer shroud 1204 mounted on a housing 1207 of the power tong 1101. The outer shroud 1204 supports a gear profiled bolt 1206 having a lifting member 1208 connected thereto. Rotation of a gear 1216 mated with the gear profiled bolt 1206 lowers and raises the gear profiled bolt 1206 between a power tong gate locked position and a power tong gate unlocked position. In the power tong gate locked position shown in FIG. 16, the gear profiled bolt 1206 inserts downward into an aperture within the extension 1132 and an aperture in the corresponding grooved portion 1134 that form the gate in the housing 1207 of the power tong 1101. Thus, the gear profiled bolt 1206 maintains the power tong 1101 in the closed position by preventing movement between the extension 1132 and the corresponding grooved portion 1134 when in the power tong gate locked position. The gear may be actuated by a hydraulic or electric motor (not shown) controlled by the tong assembly hydraulic circuit.

Figure 17:
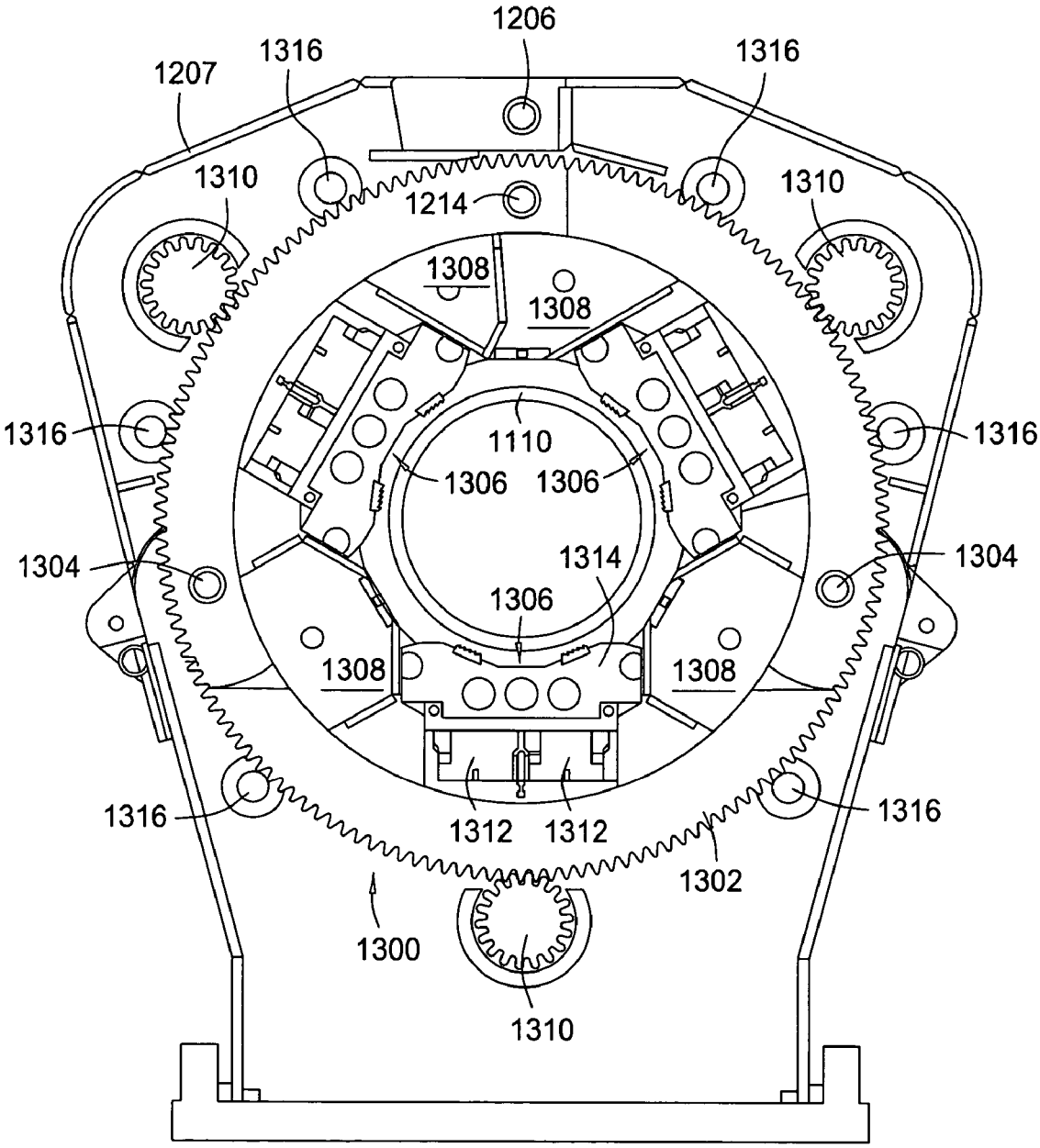
FIG. 17 is a section view of the power tong illustrating a rotor with jaws according to aspects of the invention.

At the end of the lifting member 1208, a slotted lip 1210 receives a recessed profile 1212 at the top of a rotor bolt 1214. Due to the slotted lip 1210 fitting in the recessed profile 1212, the lifting member 1208 which raises and lowers with the gear profiled bolt 1206 acts to raise and lower the rotor bolt 1214 when the rotor bolt 1214 is aligned below the lifting member 1208. Similar to the housing of the power tong 1101, a rotor 1300 is gated so that the rotor 1300 opens and closes as the power tong 1101 moves between the open and closed positions. Thus, the rotor 1300 includes a rotor extension 1232 and a corresponding rotor grooved portion 1234 that each have an aperture therein for receiving the rotor bolt 1214 which prevents movement between the rotor extension 1232 and the corresponding rotor grooved portion 1234 while in the power tong gate locked position. As the rotor 1300 rotates during make up and break out operations, the recessed profile 1212 of the rotor bolt 1214 slides out of engagement with the slotted lip 1210 and may pass through the slotted lip 1210 with each revolution of the rotor 1300. The rotor bolt 1214 realigns with the lifting member 1208 when the rotor returns to a start position such that the rotor bolt 1214 may be raised to the power tong gate unlocked position. Only when the rotor 1300 is in the start position with segments of the rotor 1300 properly aligned may the power tong 1101 be moved to the open position. FIG. 17 further illustrates the power tong 1101 in the start position with the rotor bolt 1214 and the gear profiled bolt 1206 maintaining the power tong 1101 in the closed position.

The back up gate lock 1201 locks the gate on the back up tong 1102 in the closed position similar to the power tong gate lock 1200 for the power tong 1101. A single back up bolt 1218 operated by a gear 1220 moves between a back up gate locked position and a back up gate unlocked position. Since the back up tong 1102 does not have a front housing or a rotor that rotates, a back up jaw assembly may include a gated section therein with mating features such as the gate of the power tong 1101. Thus, the bolt 1218 in the back up gate locked position prevents movement between members in the gated section of the back up jaw assembly similar to the gear profiled bolt 1206 and rotor bolt 1214 used in the power tong gate lock 1200 on the power tong 1101.

Referring still to FIG. 16, the rotor lock 1202 mounts to the housing 1207 of the power tong 1101 and includes a body 1222, a female end 1224, a piston 1225 and a spring 1228. The rotor lock 1202 moves between a rotor locked position and a rotor unlocked position. The rotor lock 1202 normally biases to the rotor locked position and must be actuated by fluid pressure from the tong assembly hydraulic circuit to the rotor unlocked position. In the rotor locked position shown, the female end 1224 coupled to the piston 1225 receives a male member 1226 protruding from the rotor 1300. The male member 1226 aligns below the female end 1224 when the rotor 1300 is in the start position. The engagement between the female end 1224 and the male member 1226 prevents rotation and movement of the portion of the rotor having the male member 1226 thereon. As shown in the top view of the power tong 1101 in FIG. 18, the power tong 1101 may include two rotor locks 1202 on each side which may be aligned with pivot points 1304 (shown in FIG. 17) where the front segments of both the housing 1207 and rotor 1300 open. Thus, the rotor locks 1202 may engage both front opening segments of the rotor 1300 to secure the segments relative to the housing 1207 of the power tong 1101 when the power tong 1101 is in the open position. Prior to make up or break out operations, the female end 1224 retracts to the rotor unlocked position by fluid pressure applied to the piston 1225 in order to urge the piston 1225 upward against the bias of the spring 1228. Thus, the rotor lock 1202 permits rotation of the rotor 1300 only when in the rotor unlocked position since the female end 1224 and male member 1226 disengage.

FIG. 17 illustrates the rotor 1300 within the power tong 1101. The rotor 1300 includes a segmented rotary gear 1302, three active jaws 1306, and support members 1308 disposed between the jaws 1306. The support members 1308 are fixed within the inner diameter of the rotary gear 1302 such that the jaws 1306 and the support members 1308 rotate with the rotary gear 1302. Prior to rotating the rotor 1300, the jaws 1306 move inward in a radial direction from a release position shown to a gripping position with the jaws 1306 in gripping contact with the tubular 1110. A spring (not shown) biases the jaws 1306 to the release position. Each of the jaws 1306 include two pistons 1312 hydraulically operated by a separate rotor hydraulic circuit to push a jaw pad 1314 against the tubular 1110 in the gripping position. Three pinions 1310 driven by the three motors 1111 (shown in FIG. 15) mesh with an outer circumference of the rotary gear 1302 in order to rotate the rotor 1300 during make up and break out operations. Since the pivot points 1304 for both the housing 1207 and rotor 1300 are the same, there is no relative movement between the rotor 1300 and housing 1207 as the power tong 1101 moves between the open and closed positions. Consequently, the two motors 1111 on the front segments of the housing 1207 do not move relative to the rotary gear 1302 such that it is not necessary to actuate the two motors 1111 as the power tong 1101 opens and closes.

The rotary gear 1302 may be tensioned prior to assembly such that the rotary gear 1302 is initially deformed. Thus, when the rotary gear 1302 is assembled in the power tong 1101 and when the tubular 1110 is gripped by the jaws 1306, the deformed rotary gear reworks to obtain a circular outer circumference.

Support rollers 1316 hold the rotary gear 1302 in order to axially position the rotor 1300 within the power tong 1101. Each of the pinions 1310 creates a force on the rotary gear 1302 that is perpendicular to the tangential. Due to the 1120° spacing of the pinions 1310, these forces are all directed to the center of the rotor 1300 and cancel one another, thereby centrally aligning the rotor 1300. Therefore, the rotor 1300 does not require radial guiding since the rotary gear 1302 centrally aligns itself when a load is placed on the pinions 1310 arranged at 120° around the rotary gear 1302.

The jaws 1306 and support members 1308 laterally support one another throughout a 360° closed circle such that corresponding torque from the rotor 1300 only transmits to the tubular 1110 in a tangential direction without resulting in any tilting of the jaws 1306. During make up and break out operations, a side face of one jaw 1306 having a close contact with a side face of an adjacent support member 1308 transmits force to the adjacent support member 1308 which is in close contact with another jaw 1306. The closed 360° arrangement effectively locks the jaws 1306 and support members 1308 in place and helps the jaws 1306 and support members 1308 to laterally support one another, thereby inhibiting tilting of the jaws 1306. Thus, load on the tubular 1110 equally distributes at contact points on either side of the jaw pads 1314. Adapters (not shown) for both the support members 1308 and jaws 1306 may be added in order to allow the power tong 1101 the ability to grip tubulars having different diameters.

The jaw assembly (not shown) in the back up tong 1102 may be identical to the rotor 1300. However, the jaw assembly in the back up tong 1102 does not rotate such that an outer ring surrounding jaws in the back up tong may not be geared with motors providing rotation.

Figure 18:
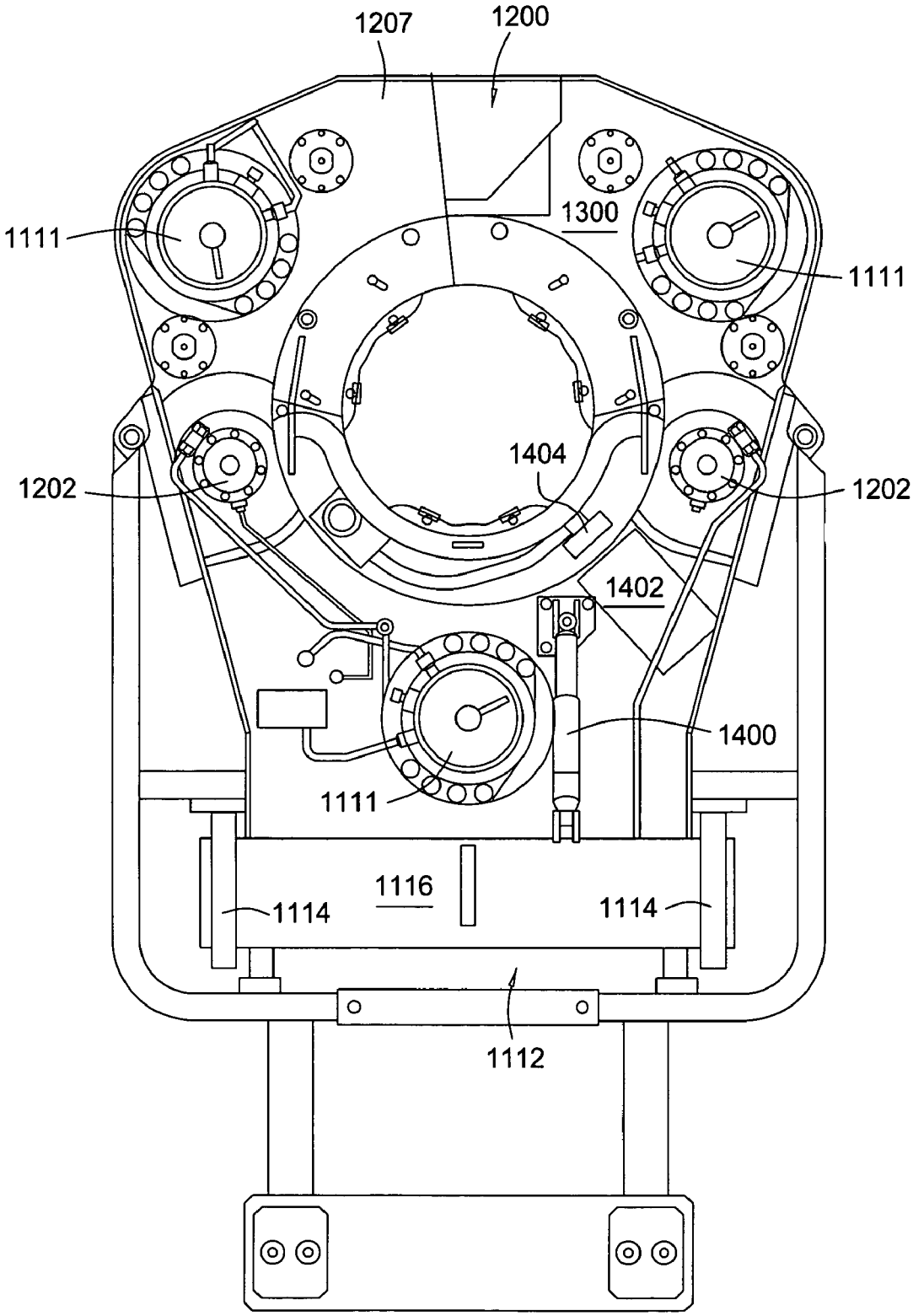
FIG. 18 is a top view of the power tong.

The top view of the power tong 1101 in FIG. 18 shows a motor 1402 used to operate a pump 1404 that supplies hydraulic pressure to the rotor hydraulic circuit that actuates the jaws 1306. The motor 1402 may be actuated by the tong assembly hydraulic circuit. The motor 1402 mounts on the housing 1207 while the pump mounts on the rotor 1300. Therefore, the motor 1402 must disengage from the pump 1404 after the pump 1404 actuates the jaws 1306 in order to allow the pump 1404 to rotate with the rotor 1300 during make up and break out operations.

Figure 19:
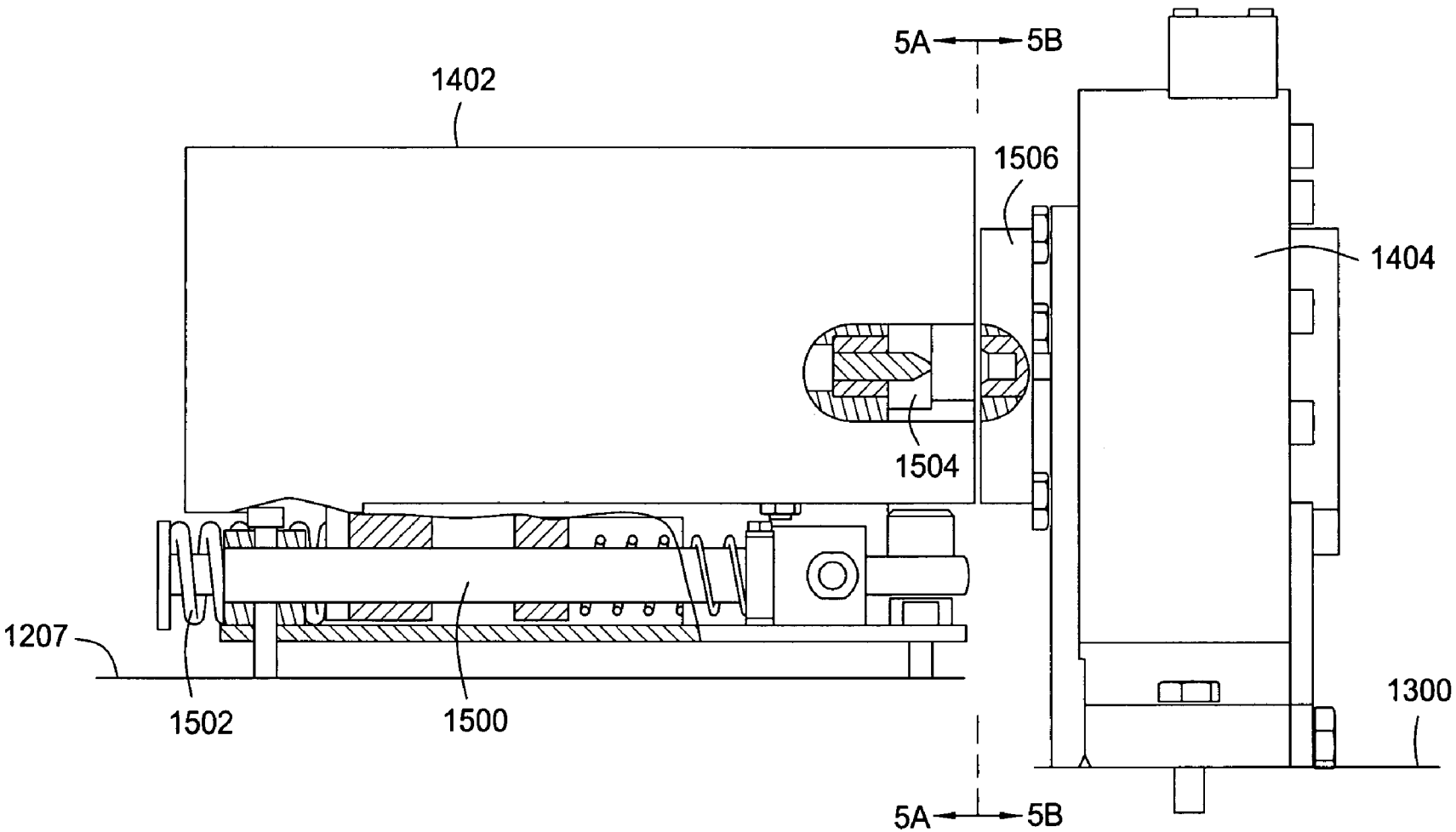
FIG. 19 is a side view of a motor disposed on a housing of the power tong that operates a pump on the rotor in order to actuate the jaws.
Figure 19B:
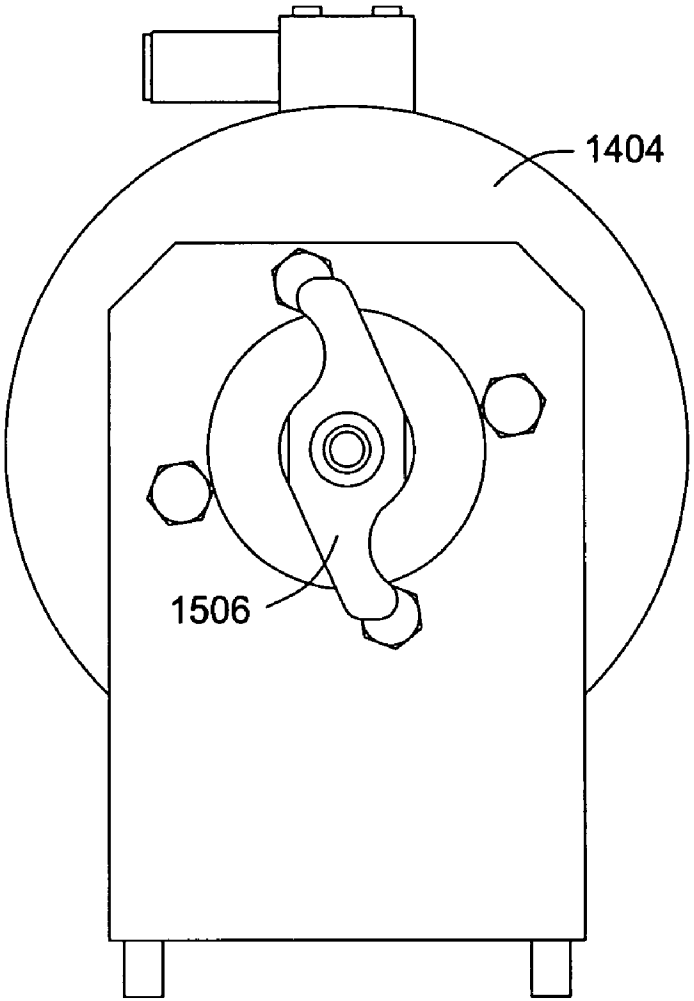
FIG. 19B is a view of an end of the pump along line 19B-19B in FIG. 19.
Figure 19A:
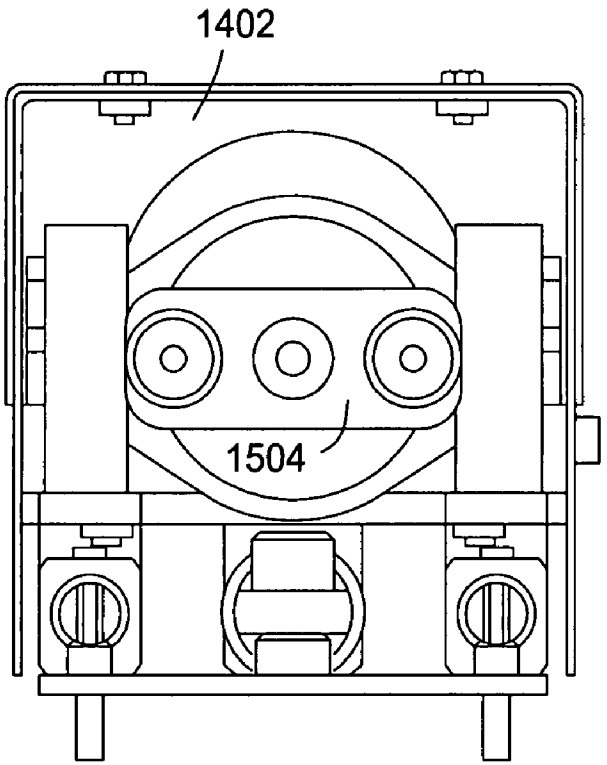
FIG. 19A is a view of an end of the motor along line 19A-19A in FIG. 19.

FIGS. 19, 19A and 19B illustrate a releasable coupling arrangement between the motor 1402 secured to the housing 1207 and the pump 1404 secured to the rotor 1300. The motor 1402 slides along a guide shaft 1500 between an engaged position toward the pump 1404 and a disengaged position away from the pump 1404. As shown, a spring 1502 biases the motor 1402 to the disengaged position. Hydraulic fluid supplied from the tong assembly hydraulic circuit moves the motor 1402 against the bias of the spring 1502 toward the pump 1404. As the motor 1402 moves toward the pump 1404, a coupling such as a claw 1504 of the motor 1402 engages a mating coupling such as an elongated S-shaped bar 1506 of the pump 1404. The claw 1504 and the S-shaped bar 1506 provide a wide angle for possible engagement with each other. However, the claw 1504 and S-shaped bar 1506 may interferingly hit one another without engaging. To simplify the next engagement of the claw 1504 with the S-shaped bar 1506 due to a missed engagement or for subsequent operations of the pump 1404, the motor 1402 rotates the claw 1504 a small amount as the motor 1402 slides on the guide shaft 1500 back to the disengaged position. As shown in further detail in FIG. 21, pressurized fluid used to fill a piston chamber in order to move the motor 1402 on the guide shaft 1500 toward the pump 1404 flows to the motor 1402 to turn the claw 1504. Since the volume of the piston chamber remains the same, the claw 1504 of the motor 1402 rotates a fixed amount with every movement of the motor 1402 between the engaged and disengaged positions.

Figure 20:
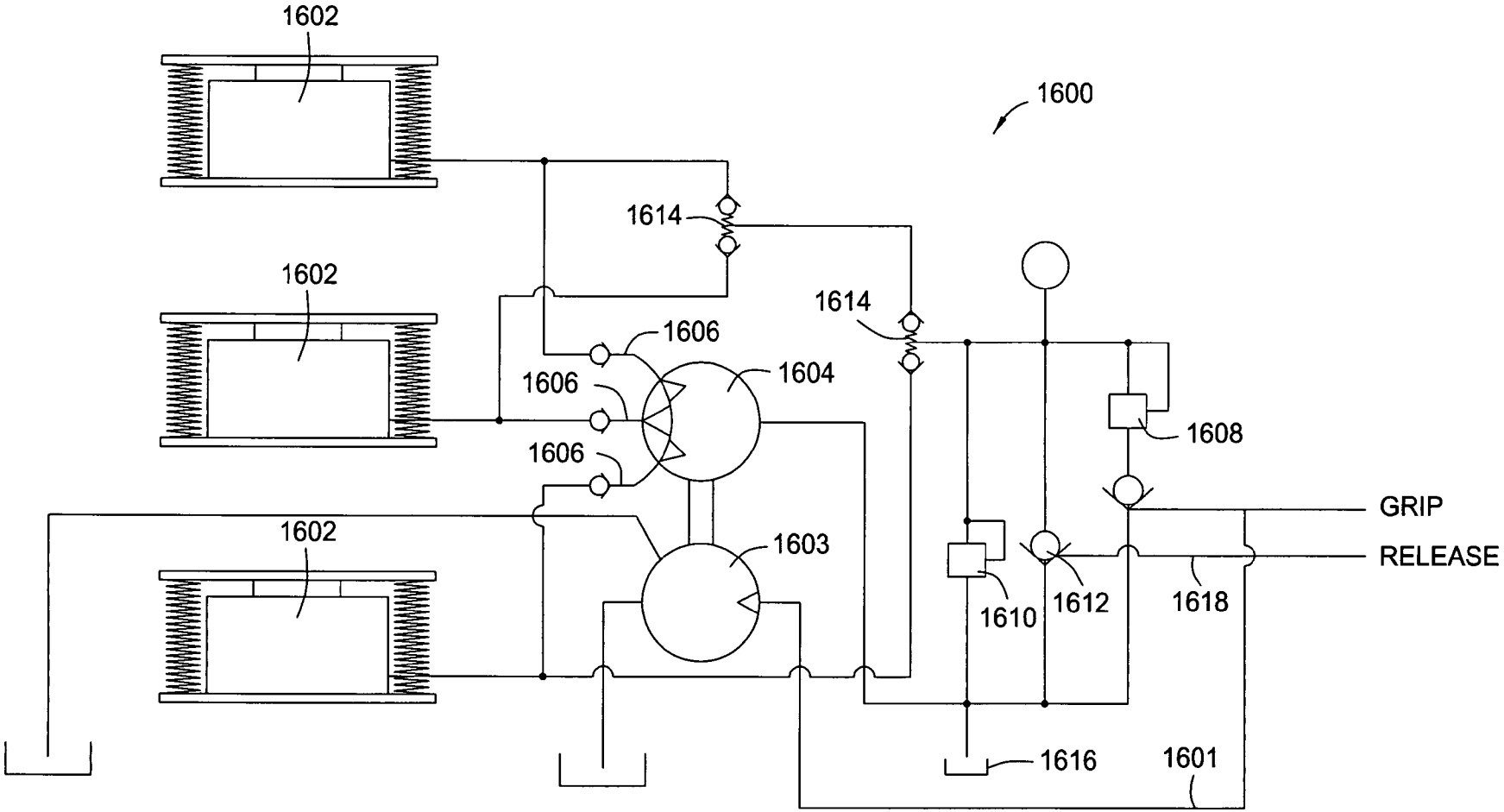
FIG. 20 is a schematic of a back up tong hydraulic circuit used to actuate jaws of the back up tong.

FIG. 20 illustrates a schematic of a back up tong hydraulic circuit 1600 used to actuate jaws 1602 of the back up tong 1102 in order to grip the lower tubular 1108 as shown in FIG.

15. A grip line 1601 from the tong assembly hydraulic circuit selectively supplies fluid pressure to a back up tong motor 1603 that operates a single back up tong pump 1604. The jaws 1602 of the back up tong 1102 connect to the back up tong pump 1604 which supplies an equal volume and pressure of fluid to each of the jaws 1602 through three equal flow outlets 1606. To prevent a stop of the motor/pump 1603, 1604 with only one of the jaws 1602 in gripping contact, the hydraulic circuit 1600 provides a cascade circuit with flow from all three jaws 1602 passing to a single common adjustable pressure limiter 1608, a single common preset safety valve 1610 and a single common release check valve 1612. Due to the arrangement of the two check valves 1614, the pump 1604 continues to supply pressurized fluid even if one of the jaws 1602 grips prior to the other jaws 1602. Pressurized fluid supplied to the jaw gripping prematurely flows to the tank 1616 while the other jaws continue to receive fluid pressure for proper actuation. Therefore, there is no volumetric influence of one of the jaws 1602 with respect to the other jaws. After completing the make up or break out operation, a hydraulic signal through a release line 1618 of the tong assembly hydraulic circuit opens the release check valve 1612 and permits fluid pressure acting on the jaws 1602 to dump to the tank 1616. The back up tong hydraulic circuit 1600 with the pump 1604 may supply high pressures such as greater than 6000 pounds per square inch or 1500 bar.

Figure 21:
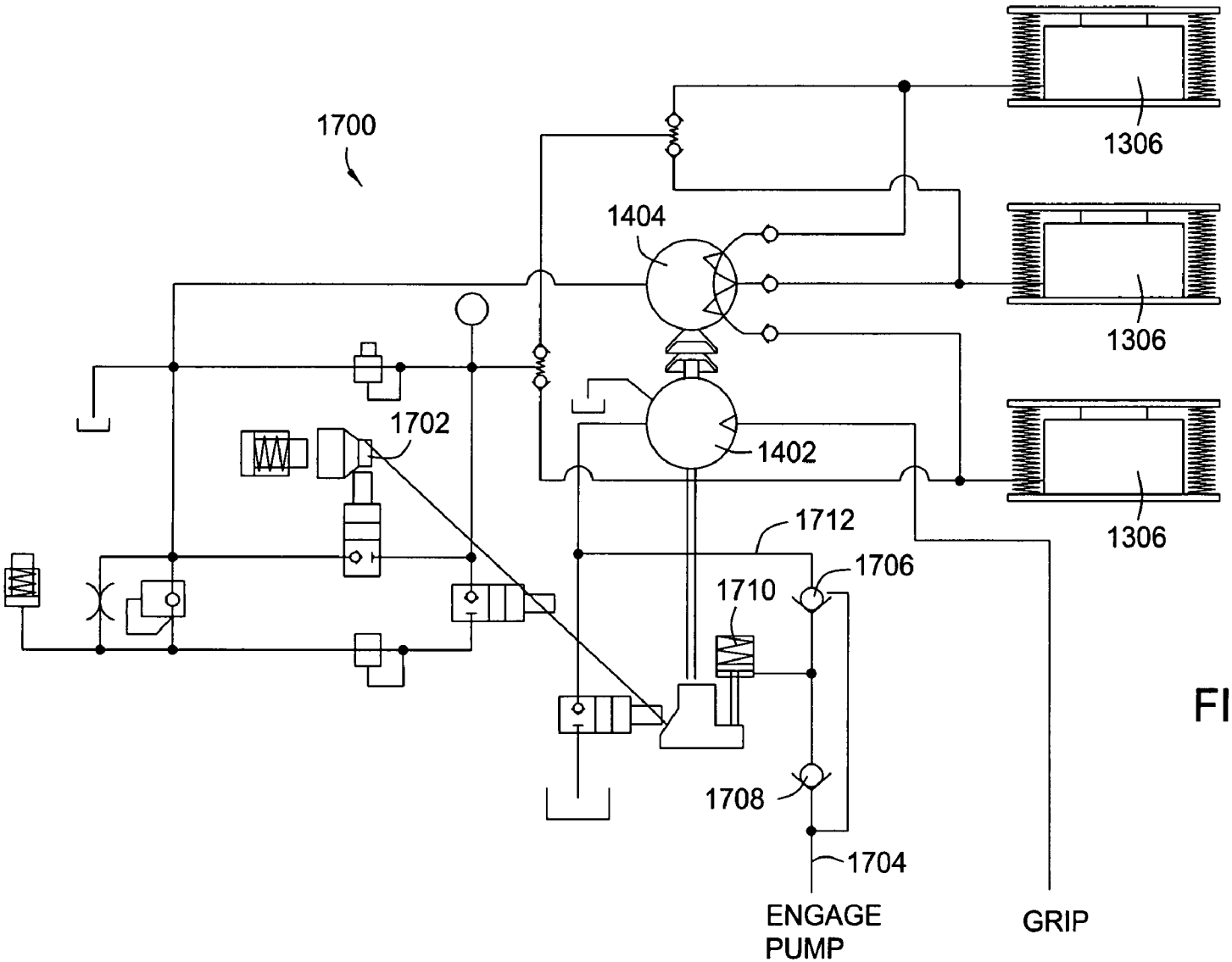
FIG. 21 is a schematic illustrating engagement of the motor and the pump used in a rotor hydraulic circuit that actuates the jaws of the power tong.

FIG. 21 shows a schematic illustrating engagement of the motor 1402 and the pump 1404 used in a rotor hydraulic circuit 1700 that actuates the jaws 1306 of the power tong 1101. The jaws 1306 actuate through a similar manner as described above with respect to the back up tong hydraulic circuit 1600 in FIG. 20. However, a release valve 1702 is opened upon completing the make up or break out operation. The schematic in FIG. 21 also illustrates the motor 1402 that is moveable between the engaged and disengaged positions. To move the motor 1402 from the disengaged position to the engaged position, fluid selectively supplied from the tong assembly hydraulic circuit to an engage pump line 1704 passes through check valve 1708 and enters piston chamber 1710 in order to move the motor 1402 toward the pump 1404. The fluid pressure in the engage pump line 1704 closes check valve 1706. However, release of fluid pressure from the engage pump line 1704 permits pressurized fluid from the piston chamber 1710 to pass through check valve 1706 into a motor drive line 1712 in order to rotate a claw 1504 of the motor 1402 as described above when the motor returns from the engaged position to the disengaged position.

Figure 22:
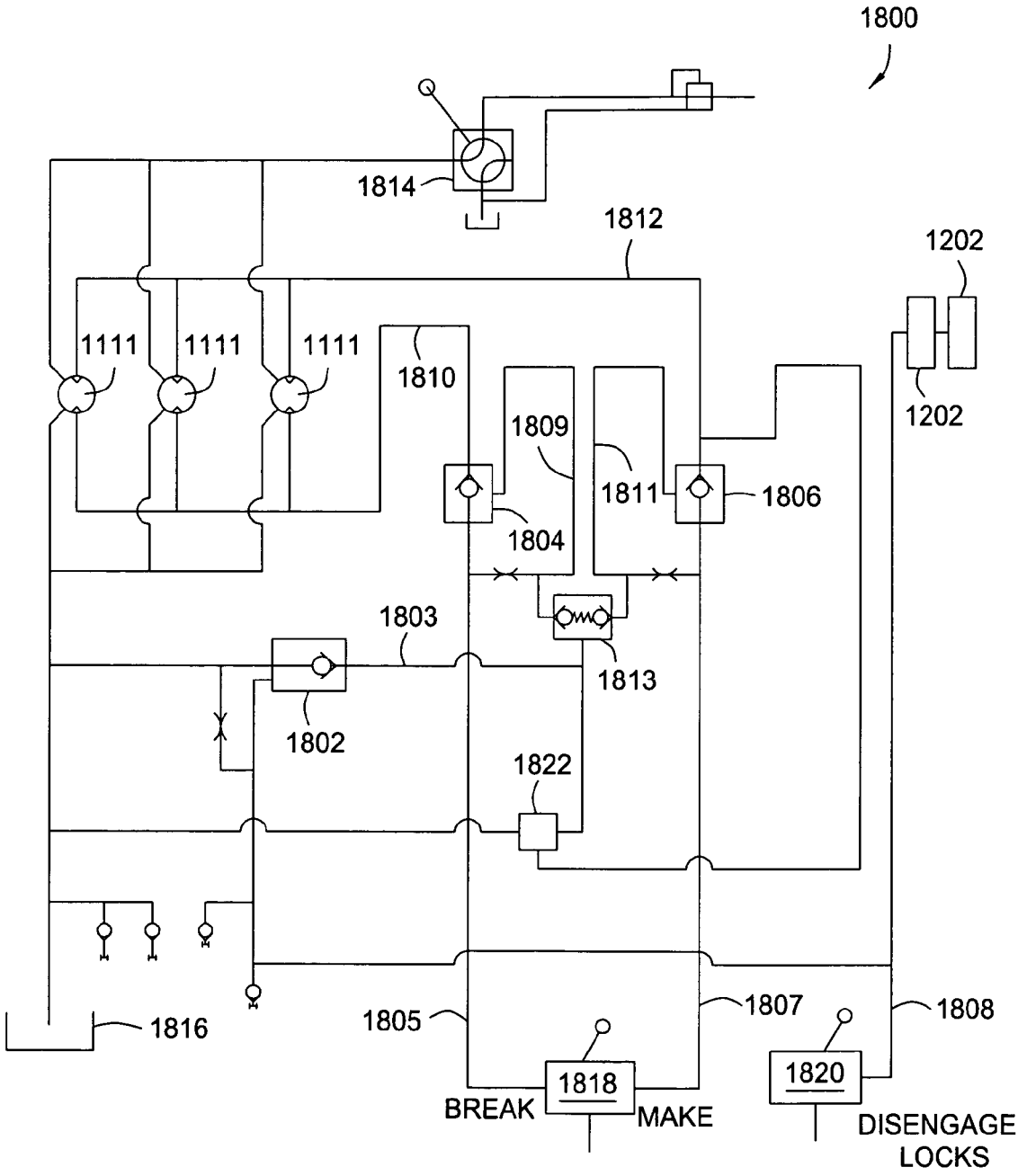
FIG. 22 is a schematic of a portion of a tong assembly hydraulic circuit that provides a safety interlock between the rotor lock and fluid supplied to operate drive motors.

FIG. 22 illustrates an interlock portion 1800 of the tong assembly hydraulic circuit that provides a safety interlock that includes the rotor locks 1202 and a motor lockout that selectively blocks fluid supplied to operate the drive motors 1111. The interlock portion 1800 includes a normally open pilot valve 1802 having an input from a dump line 1803 and an output to a tank 1816, a first check valve 1804 having an input from a break out supply line 1805 and an output to a reverse drive line 1810, and a second check valve 1806 having an input from a make up supply line 1807 and an output to a forward drive line 1812. An automated or manually operated drive valve 1818 selectively supplies fluid pressure to one of the supply lines 1805, 1807 at the appropriate time. Fluid supplied through the reverse drive line 1810 operates the motors 1111 for break out, and fluid supplied through the forward drive line 1812 operates the motors 1111 in an opposite direction for make up. Thus, the drive motors 1111 only operate when the check valves 1804, 1806 can open to permit fluid flow between one of the supply lines 1805, 1807 and a corresponding one of the drive lines 1810, 1812. A first pilot port line 1809 connects a pilot port of the first check valve 1804 with the break out line 1805, and a second pilot port line 1811 connects a pilot port of the second check valve 1804 with the make up line 1807. The check valves 1804, 1806 only open when the pilot port lines 1809, 1811 supply fluid pressure to the pilot ports. However, the pilot port lines 1809, 1811 do not supply an opening pressure to the pilot ports of the check valves 1804, 1806 when the pilot valve 1802 is open since the pilot port lines 1809, 1811 connect through check valve 1813 to the dump line 1803 that passes fluid to the tank 1816 when the pilot valve 1802 is open.

As described above, the rotor locks 1202 physically block rotation of the rotor 1300 until a fluid pressure is applied to the rotor locks 1202 in order to place the rotor locks 1202 in the rotor unlocked position. Thus, the fluid pressure for placing the rotor locks 1202 in the rotor unlocked position is supplied from the tong assembly hydraulic circuit through a disengage locks line 1808 that may be controlled independently from the supply lines 1805, 1807 by a lock valve 1820. A portion of the fluid from the disengage locks line 1808 is supplied to a pilot port of the pilot valve 1802 in order to close the pilot valve 1802 only when both the rotor locks 1202 are in the rotor unlocked position. Once the pilot valve 1802 closes, fluid pressure from either of the supply lines 1805, 1807 can pressurize a corresponding one of the pilot port lines 1809, 1811 that are no longer open to the tank 1816, thereby permitting opening of a corresponding one of the check valves 1804, 1806. Thus, opening the drive valve 1818 supplies fluid selectively to one of the supply lines 1805, 1807, which are blocked from operating the drive motors 1111 until actuation of the rotor locks 1202 unlocks the interlock that provides the motor lockout. Once both the rotor locks 1202 actuate and the drive valve 1818 is opened to permit fluid flow to the appropriate supply line 1805, 1807, a pressurized fluid is simultaneously supplied to all of the motors 1111 through a corresponding one of the drive lines 1810, 1812 during make up or break out. Further, each motor 1111 produces the same torque and any mechanical parts for "locking" such torque are not necessary as all the motors 1111 simultaneously stop hydraulically due to the check valves 1804, 1806. A gear change 1814 may be used to adjust the suction volume of the motors 1111 in order to adjust the speed of the motors 1111. Additionally, a solenoid valve (not shown) can be activated such that the drive motors 1111 are also immediately stopped, and a pressure limiter 1822 may protect the interlock portion 1800.

In alternative embodiments, the pilot valve 1802 is closed by a signal other than the hydraulic signal from the disengage locks line 1808. For example, the pilot valve 1802 may be controlled to close by an electric signal supplied thereto or may be manually closed. Further, the hydraulic circuit shown for the interlock portion 1800 may be used in applications and methods other than tong assembly 1100 where there is a desire to block actuation of motors prior to receiving a signal from an interlock.

The tong assembly 1100 described herein may be used in a method of making up a tubular connection between a first tubular 1110 and a second tubular 1108. For clarity, the method is described using the reference characters of the figures described herein when possible. The method includes opening a power tong 1101 and back up tong 1102 of the tong assembly 1100 and positioning the tubulars 1108, 1110 therein. The method further includes, closing the tongs 1101, 1102 around the tubulars 1108, 1110, locking gate locks 1200, 1201 to maintain the tongs 1101, 1102 and a rotor 1300 in the closed position, actuating jaws 1306 of the tongs 1101, 1102 such that the power tong 1101 grips the first tubular 1110 and the back up tong 1102 grips the second tubular 1108, unlocking a rotor lock 1202 to permit rotation of the rotor 1300, and unlocking an interlock including a rotor motor lockout. Additional, the method includes rotating the rotor 1300 by distributing a drive force on the rotor 1300 such as by simultaneous rotation of at least three motors 1111, wherein rotating the rotor 1300 rotates the first tubular 1110 relative to the second tubular 1108 and forms the connection. The method may be used with connections in tubulars having diameters greater than fifteen inches such as risers.

In another aspect, the tong assembly may be suspended from a tong positioning device capable of translating the tong assembly toward the risers to thread the connection. An exemplary tong assembly is disclosed in U.S. Pat. No. 6,412,553 assigned to the same assignee as the present application and is herein incorporated by reference in its entirety. In one embodiment, the positioning device comprises a single extendable beam having a variable length. A mounting assembly is coupled to one end of the beam for attachment to the rig, and the tong is suspended from the free end of the beam. The positioning device includes a motive assembly such as a piston and cylinder assembly adapted to extend or retract the beam. Extending or retracting the beam moves the tong to and away from the risers. The piston and cylinder assemblies may be operated by hydraulics, pneumatics, electrics, mechanics, and combinations thereof. In the preferred embodiment, the piston and cylinder assembly is adapted for remote controlled operation as is known to a person of ordinary skill in the art. For example, the power source of the piston and cylinder assemblies may be controlled remotely.

In another aspect, the tong may be placed on a movable frame to transport the tong to and from the well center. Examples of such movable frames are disclosed in U.S. patent application Ser. No. 10/074,947, filed on Feb. 12, 2002, and U.S. patent application Ser. No. 10/432,059, filed on May 15, 2003 and published as U.S. Publication No. 2004/0035573, which applications are herein incorporated by reference in their entirety. In one embodiment, actuation of the movable frame is remotely controlled.

Another suitable positioning device comprises a flexible chain provided with compression members and a flexible locking chain. The chains are brought into operative engagement to form a rigid member when a hydraulic motor is rotated counter-clockwise. The proximal end of the device is attached to the rig, while the distal end is suspended by a cable connected to the rig. A tong suspended from the distal end of the device may be advanced or withdrawn towards the riser by rotating the motor counter-clockwise or clockwise to extend or dismantle the rigid member. In the preferred embodiment, the hydraulic motor is adapted for remote controlled operation as is known to a person of ordinary skill in the art. Examples of such tong positioning devices are disclosed in U.S. Pat. Nos. 6,322,472; 5,667,026; and 5,368,113, which patents are assigned to the same assignee of the present invention and are herein incorporated by reference in their entirety.

Referring back to FIG. 12, the operation of the tubular handling system will now be discussed in more detail. Initially, at step 500, the riser string is retained in the wellbore and prevented from axial movement by the spider 370. Sensor data 502 from the spider piston sensor 380 indicating that the spider 370 is closed is transmitted to the controller 390. At step 510, the elevator 250 is moved to engage a riser section to be connected with the riser string. When the elevator 250 is closed around the riser section, the sensor 280 sends a signal 512 to the controller 390. The traveling block is then raised to lift the riser section. At this point the weight of the riser section is supported by the joint compensator.

At step 520, the riser section is moved to the well center for connection with the riser string. A tubular guide member 101 is used to align riser section with the riser string. Specifically, the gripping member 120 is extended toward the riser section and closed around the riser section. Preferably, movement of the gripping member 120 is remotely controlled and performed by recalling a previous position of the gripping member 120. The tubular guide member 101 positions the riser section in alignment with the riser string for connection therewith.

Next, at step, 530, a tong assembly 1100 is moved into position to connect the riser section to the riser string. In one embodiment, a single extendable beam type tong positioning device is actuated to translate the tong toward the risers. The piston and cylinder assembly of the beam is remotely controlled to move the tong. Once in position, the backup tong is actuated to engage the riser string and the power tong is actuated to engage the riser section. Thereafter, torque is supplied to the power tong to rotate the riser section relative to the riser string to make up the connection. As the threads are advanced, the joint compensator compensates for the axial movement of the riser section toward the riser string. Also, the rotary seal allows the lower elevator 250 to maintain communication with the remote controller during rotation of the riser section.

After the connection is completed, at step 540, the spider 370 disengages from the riser string. The lower elevator 250 is raised to transfer the weight of the extended riser string to the upper elevator 220. Thereafter, the spider is opened to allow passage of the riser string. In one embodiment, the shock table 300 is opened by first releasing the remotely controllable pin 325, and then actuating the cylinder assembly 345 to pull apart the two base portions 321, 322. At step 550, the extended riser string is then lowered through the spider 370. Thereafter, at step 560, the spider 370 reengages the riser string. After engagement, at step 560, the spider piston sensor 380 transmits the sensor data 562 to the controller 390. After receiving the sensor data 562 indicating that the spider 370, the controller 390 allows the elevator 250 to disengage from the riser string and pick up another riser for connection with the riser string. In this manner, the tubular handling assembly may be used to extend the riser string to the desired length. Although only some of the steps in the process is described as being remotely controlled, it must be noted that manipulation of the components of the tubular handling assembly throughout the entire process may be controlled remotely or automated. For example, all of the piston and cylinder assemblies in each of the components may be adapted for remote control capability. Moreover, the controls may be position in the same small area for easy access to the operator.

In another aspect, a fill up tool may be used with the tubular handling system. In one embodiment, two joint compensators are used to compensate for the thread action. Specifically, the upper end of one of the joint compensators is attached to one side of the upper elevator, and the lower end is coupled to a swivel via a cable. Additionally, cables extending below the swivel connect the lower elevator to the swivel. Before a tubular section is connected to the tubular string retained by the spider, the weight of the tubular section retained by the lower elevator is supported by the joint compensators. After the tubulars are connected, the upper elevator is lowered toward the rig floor to retain the tubulars, thereby supporting the weight of the connected tubulars. In one embodiment, the lower elevator may be a single joint elevator and the upper elevator may be a side door elevator.

A suitable fill up tool is disclosed in U.S. patent application Ser. No. 6,460,620, which application is assigned to the same assignee of the present invention and is herein incorporated by reference in its entirety. In one embodiment, the fill up tool is a mudsaver valve having an elongated tubular main body supporting a tubular mandrel-like mudsaver closure member therein for movement between valve open and closed positions. A coil spring is disposed in the main body member and is engageable with the mudsaver closure member to bias the mudsaver closure member in a valve closed position. The mudsaver closure member includes an axial passage formed therein and ports opening from the axial passage to the exterior of the mudsaver closure member. The mudsaver closure member is engageable with an annular resilient packoff element and is pressure biased to move to an open position wherein the ports pass through the annular packoff element to allow fluid to flow through the valve. A flowback valve is integrated with the mudsaver valve and comprises an annular resistant duckbill type closure member mounted in a second body member attached to the main body member and responsive to pressure fluid in a casing in which the mudsaver valve is disposed to equalize fluid pressure between the interior of the casing or similar conduit and a supply conduit connected to the mudsaver valve.

While the foregoing is directed to the preferred embodiment of the present invention, other and further embodiments of the invention may be devised without departing from the basic scope thereof, and the scope thereof is determined by the claims that follow.

We claim:

1. A tubular handling system, comprising:

a first support member adapted to support a tubular utilizing a first portion of a shoulder of the tubular;

a second support member adapted to support the tubular utilizing a second portion of the shoulder; and a rotary seal adapted to provide communication between the first support member and a controller while allowing rotation of the first support member.

2. The tubular handling system of claim 1, wherein at least one of the first support member and the second support member is remotely controllable.

3. The tubular handling system of claim 1, further comprising a joint compensator.

4. The tubular handling system of claim 3, wherein the communication between the first support member and the controller comprises transmitting a fluid signal or an electric signal.

5. The tubular handling system of claim 3, wherein the rotary seal maintains communication between the first support member and the controller during rotation of the first support member.

6. The tubular handling system of claim 1, wherein the first support member comprises a fluid operated side door elevator.

7. The tubular handling system of claim 6, wherein the side door elevator further comprises a sensor for determining whether the elevator is opened or closed.

8. The tubular handling system of claim 1, further comprising a rotary table for supporting the second support member.

9. The tubular handling system of claim 8, wherein the rotary table is adapted to absorb a force experienced by the second support member.

10. The tubular handling system of claim 9, wherein the rotary table comprises a polyurethane layer.

11. The tubular handling system of claim 9, wherein the rotary table comprises one or more piston and cylinder assemblies.

12. The tubular handling system of claim 11, wherein the rotary table is remotely controllable between an open position and a closed position.

13. The tubular handling system of claim 1, further comprising an interlock system for ensuring the tubular is retained by at least one of the first support member and the second support member.

14. The tubular handling system of claim 1, further comprising a tubular guide member for positioning the tubular.

15. The handling apparatus of claim 1, wherein the first and second support members support the tubular at the same time.

16. The tubular handling system of claim 1, further comprising a tong assembly for connecting the tubular with a second tubular.

17. The tubular handling system of claim 16, further comprising tong positioning device.

18. The tubular handling system of claim 17, wherein the tong positioning device comprises a single extendable beam having variable length.

19. The system of claim 1, wherein the rotary seal comprises a rotatable portion at least partially disposed in a non-rotatable portion.

20. The system of claim 19, wherein the rotatable portion is in fluid communication with the non-rotatable portion.

21. The system of claim 20, wherein the rotary seal comprises a rotatable portion at least partially disposed in a non-rotatable portion.

22. The system of claim 19, wherein the rotatable portion maintains fluid communication with the non-rotatable portion during rotation of the rotatable portion.

23. The tubular handling system of claim 1, wherein the communication between the first support member and the controller comprises transmitting a fluid signal or an electric signal.

24. The tubular handling system of claim 1, wherein the rotary seal maintains communication between the first support member and the controller during rotation of the first support member.

25. The tubular handling system of claim 1, wherein the first portion and the second portion are radially displaced from each other.

26. The tubular handling system of claim 1, wherein the first portion and the second portion comprise two different locations of the shoulder.

27. A method of handling a tubular, comprising:

providing a rotary seal to provide communication between the first support member and a controller;

supporting the tubular along a first downward facing portion of an upset using a first support member;

supporting the tubular along a second downward facing portion of the upset using a second support member; and remotely controlling at least one of the first support member and the second support member.

28. The method of claim 27, further comprising compensating for movement of the tubular during connection of the tubular with a second tubular.

29. The method of claim 27, further comprising translating a tong into position to connect the tubulars.

30. The method of claim 29, further comprising remotely operating the tong assembly.

31. The method of claim 27, further comprising providing a fluid to the first support member during rotation of the tubular.

32. The method of claim 27, further comprising absorbing a load experienced by the second support member.

33. The method of claim 32, wherein the load is absorbed by a rotary table.

34. The method of claim 33, further comprising remotely opening or closing the rotary table.

35. The method of claim 27, further comprising ensuring at least one of the first support member or the second support member is retaining the tubular.

36. A method of handling tubulars, comprising:

supporting a first tubular using a spider;

sending data relating to retention of the first tubular from the spider to a controller;

supporting a second tubular using an elevator;

sending data relating to retention of the second tubular from the elevator to the controller;

connecting the second tubular to the first tubular;

disengaging the spider from the first tubular;

lowering a portion of the second tubular through the spider;

engaging the spider to the second tubular;

sending data relating to retention of the second tubular from the spider to the controller; and disengaging the elevator from the second tubular.

37. The method of claim 36, wherein supporting the second tubular using the elevator comprises supporting the second tubular along a first downward facing portion of an upset; and supporting the second tubular using the spider comprises supporting the second tubular along a second downward facing portion of the upset.

38. The method of claim 36, further comprising ensuring at least one of the spider and the elevator is supporting the second tubular.

39. The method of claim 36, further comprising compensating for the axial movement of the second tubular while connecting the second tubular to the first tubular.

40. The method of claim 36, further comprising providing a tubular guide member to align the second tubular to the first tubular prior to connecting.

41. The method of claim 36, wherein the spider disposed on a shock table.

42. A tubular handling system, comprising:

a first support member adapted to support a tubular utilizing a first portion of an upset of the tubular;

a second support member adapted to support the tubular utilizing a second portion of the upset;

a rotary seal adapted to provide communication between the first support member and a controller while allowing rotation of the first support member; and a rotary table for supporting the second support member.

43. The tubular handling system of claim 42, wherein the rotary table is adapted to absorb a force experienced by the second support member.

44. The tubular handling system of claim 43, wherein the rotary table comprises a polyurethane layer.

45. The tubular handling system of claim 43, wherein the rotary table comprises one or more piston and cylinder assemblies.

46. The tubular handling system of claim 45, wherein the rotary table is remotely controllable between an open position and a closed position.

47. A tubular handling system, comprising:

a first support member adapted to support a tubular utilizing a first portion of an upset of the tubular;

a second support member adapted to support the tubular utilizing a second portion of the upset;

a rotary seal adapted to provide communication between the first support member and a controller while allowing rotation of the first support member; and a tong assembly for connecting the tubular with a second tubular.

48. The tubular handling system of claim 47, further comprising tong positioning device.

49. The tubular handling system of claim 48, wherein the tong positioning device comprises a single extendable beam having variable length.

50. A method of handling a tubular, comprising:

supporting the tubular along a first downward facing portion of an upset using a first support member;

supporting the tubular along a second downward facing portion of the upset using a second support member;

remotely controlling at least one of the first support member and the second support member; and providing a fluid to the first support member during rotation of the tubular.

51. The method of claim 50, further comprising compensating for movement of the tubular during connection of the tubular with a second tubular.

52. The method of claim 50, further comprising absorbing a load experienced by the second support member.

53. The method of claim 50, further comprising ensuring at least one of the first support member or the second support member is retaining the tubular.

* * * * *